US011460796B2

(12) United States Patent
Nishikata et al.

(10) Patent No.: US 11,460,796 B2
(45) Date of Patent: Oct. 4, 2022

(54) IMAGE FORMING SYSTEM

(71) Applicant: CANON KABUSHIKI KAISHA, Tokyo (JP)

(72) Inventors: Akinobu Nishikata, Matsudo (JP); Takashi Yokoya, Yoshikawa (JP); Koji Yumoto, Toride (JP); Akihiro Kawakita, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 306 days.

(21) Appl. No.: 16/850,050

(22) Filed: Apr. 16, 2020

(65) Prior Publication Data

US 2020/0356038 A1 Nov. 12, 2020

(30) Foreign Application Priority Data

May 8, 2019 (JP) ..... JP2019-088460

(51) Int. Cl.
*G03G 15/00* (2006.01)
*B65H 5/26* (2006.01)

(52) U.S. Cl.
CPC ..... *G03G 15/5062* (2013.01); *B65H 5/26* (2013.01); *G03G 15/6529* (2013.01)

(58) Field of Classification Search
CPC ..... G03G 15/5062; G03G 15/6529
See application file for complete search history.

(56) References Cited

U.S. PATENT DOCUMENTS

2001/0021036 A1* 9/2001 Nimura ..... H04N 1/00591 358/1.12

FOREIGN PATENT DOCUMENTS

JP 2003-221160 A 8/2003

OTHER PUBLICATIONS

Riki Fukuhara, U.S. Appl. No. 16/826,647, filed Mar. 23, 2020.
Koji Yumoto, U.S. Appl. No. 16/824,782, filed Mar. 20, 2020.
Yutaka Ando, U.S. Appl. No. 16/823,499, filed Mar. 19, 2020.

* cited by examiner

*Primary Examiner* — Victor Verbitsky
(74) *Attorney, Agent, or Firm* — Venable LLP

(57) ABSTRACT

An image forming system includes a first feeding portion configured to feed a recording sheet, an image forming portion, a sheet conveyance path, a second feeding portion configured to feed an inserting sheet from any of a plurality of supporting portions including a first supporting portion and a second supporting portion, a detection portion, and a controller. The controller is configured to execute, during execution of a process of feeding a first inserting sheet from the first supporting portion to the sheet conveyance path, a movement processing of moving a second inserting sheet supported on the second supporting portion to a position where a trailing edge of the second inserting sheet is placed downstream in a sheet conveyance direction of a detection position of the detection portion and thereafter stopping the second inserting sheet.

9 Claims, 19 Drawing Sheets

IMAGE FORMING SYSTEM

BACKGROUND OF THE INVENTION

Field of the Invention

The present invention relates to an image forming system configured to form an image on a sheet.

Description of the Related Art

Hitherto, an image forming system is known, which is equipped with an insert apparatus configured to feed inserting paper, in addition to a feeding portion for feeding a sheet serving as a recording medium, hereinafter referred to as a recording sheet, and which is capable of outputting a product in a state where an inserting paper is inserted between recording sheets to which image has been formed.

According to an image forming system disclosed in Japanese Patent Application Laid-Open Publication No. 2003-221160, a pre-presence/absence-detection operation and a post-presence/absence-detection operation are utilized as two control methods of operation for feeding transfer paper from a feeding portion. In pre-presence/absence-detection operation, feeding of transfer paper is started in a state where an inserting paper to be inserted immediately before the transfer paper is not confirmed to be present in the insert apparatus. In post-presence/absence-detection operation, feeding of transfer paper is started after confirming the presence of the inserting paper to be inserted immediately before the transfer paper in the insert apparatus using a sensor. The above document discloses that pre-presence/absence-detection operation is performed in a state where a remaining amount of inserting paper on an inserting paper tray provided on the insert apparatus is high, and the operation is switched to post-presence/absence-detection operation in a state where the remaining amount of inserting paper on the inserting paper tray has been reduced.

However, according to the post-presence/absence-detection operation disclosed in the above-described document, there was a case where productivity of the image forming system was deteriorated by waiting time that has occurred for confirming the presence of the inserting paper to be inserted immediately before the transfer paper.

SUMMARY OF THE INVENTION

The present invention provides an image forming system which can achieve improvement in productivity.

According to one aspect of the invention, an image forming system includes: a first feeding portion configured to feed a recording sheet; an image forming portion configured to form an image on a recording sheet fed from the first feeding portion; a sheet conveyance path through which a recording sheet on which an image has been formed by the image forming portion is conveyed; a second feeding portion including a plurality of supporting portions each configured to support an inserting sheet, and configured to feed an inserting sheet from any of the plurality of supporting portions toward the sheet conveyance path, the plurality of supporting portions including a first supporting portion and a second supporting portion; a detection portion configured to detect presence of an inserting sheet supported on each of the plurality of supporting portions; and a controller configured to execute a job including a feeding process in which a recording sheet is fed from the first feeding portion and is formed an image thereon by the image forming portion, and a process in which an inserting sheet is fed from the second feeding portion and is inserted between recording sheets, the controller being configured to execute, during execution of a process of feeding a first inserting sheet from the first supporting portion to the sheet conveyance path, a movement processing of moving a second inserting sheet supported on the second supporting portion to a position where a trailing edge of the second inserting sheet is placed downstream in a sheet conveyance direction of a detection position of the detection portion and thereafter stopping the second inserting sheet.

According to another aspect of the invention, an image forming system includes: a first feeding portion configured to feed a recording sheet; an image forming portion configured to form an image on a recording sheet fed from the first feeding portion; a sheet conveyance path through which a recording sheet on which an image has been formed by the image forming portion is conveyed; a second feeding portion including a plurality of supporting portions each configured to support an inserting sheet, and configured to feed an inserting sheet from any of the plurality of supporting portions toward the sheet conveyance path; a detection portion configured to detect presence of an inserting sheet supported on each of the plurality of supporting portions; and a controller configured to execute a job including a feeding process in which a recording sheet is fed from the first feeding portion and is formed an image thereon by the image forming portion, and a process in which an inserting sheet is fed from the second feeding portion and is inserted between recording sheets, the controller being configured to change a feed source of an inserting sheet among the plurality of supporting portions in the second feeding portion each time one inserting sheet is fed during execution of the job, and execute a feeding process of a current recording sheet if a detection result of the detection portion indicates that an inserting sheet to be inserted immediately before the current recording sheet in an order of passing through the sheet conveyance path is present on any of the plurality of supporting portions.

According to still another aspect of the invention, an image forming system includes: a first feeding portion configured to feed a recording sheet; an image forming portion configured to form an image on a recording sheet fed from the first feeding portion; a sheet conveyance path through which a recording sheet on which an image has been formed by the image forming portion is conveyed; a second feeding portion including a plurality of supporting portions each configured to support an inserting sheet, and configured to feed an inserting sheet from any of the plurality of supporting portions toward the sheet conveyance path; a detection portion configured to detect presence of an inserting sheet supported on each of the plurality of supporting portions; and a controller configured to execute a job of creating a sheet bundle in which a predetermined number of inserting sheets are inserted between a plurality of recording sheets, the job including a feeding process in which a recording sheet is fed from the first feeding portion and is formed an image thereon by the image forming portion, and a process in which an inserting sheet is fed from the second feeding portion and is inserted between recording sheets, the controller being configured to change a feed source of an inserting sheet among the plurality of supporting portions in the second feeding portion each time the predetermined number of inserting sheets are fed during execution of the job, and execute feeding processes of recording sheets used for creating a current sheet bundle if a detection result of the detection portion indicates that at least one inserting sheet to be used for creating the current sheet bundle is present on any of the plurality of supporting portions.

Further features of the present invention will become apparent from the following description of exemplary embodiments with reference to the attached drawings.

DESCRIPTION OF THE EMBODIMENTS

Now, exemplary embodiments of the present invention will be described with reference to the drawings.

First Embodiment

Figure 1:
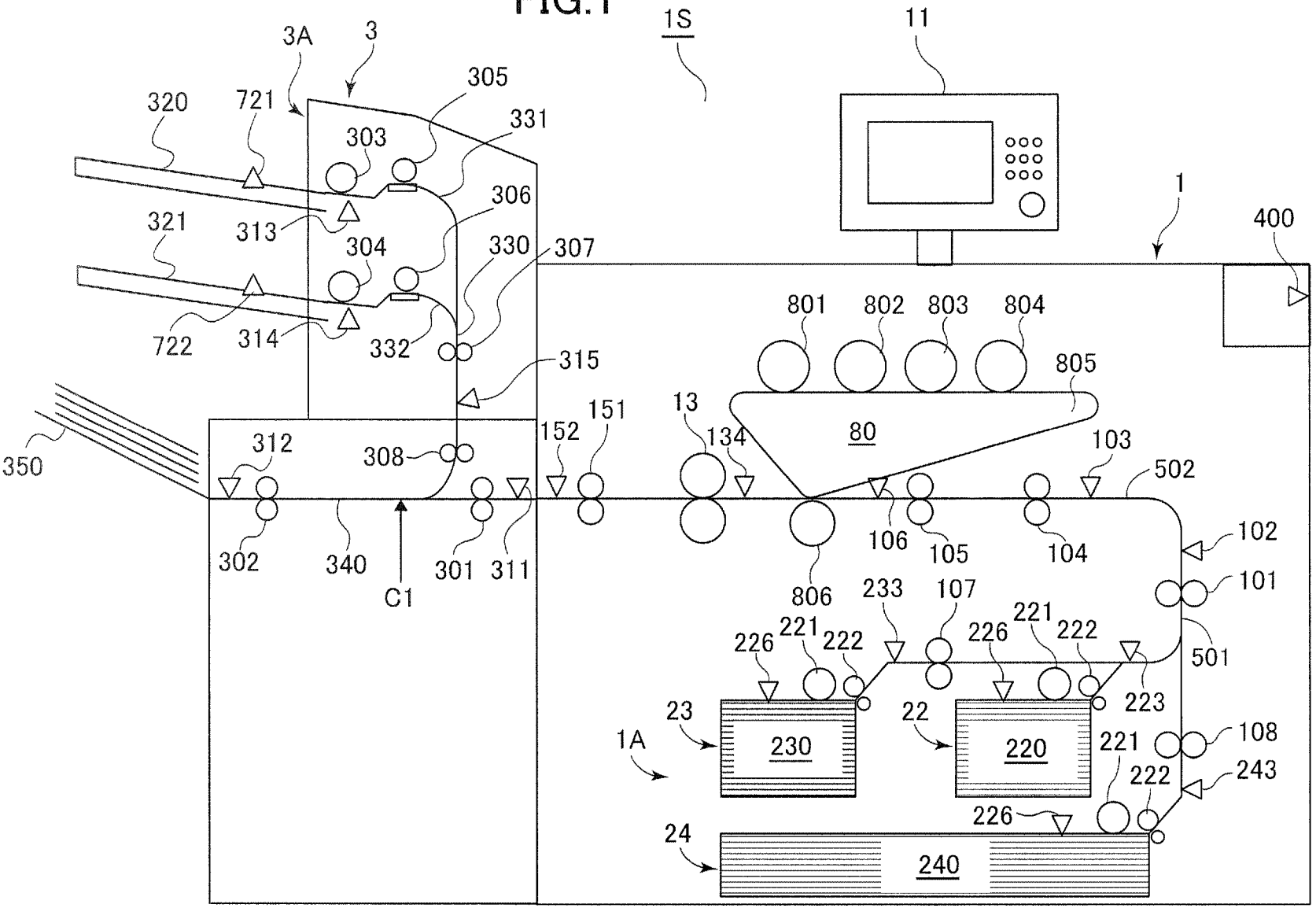
FIG. 1 is a schematic view of an image forming system according to a first embodiment.

FIG. 1 is a schematic view of an image forming system 1S according to a first embodiment. The image forming system 1S is composed of an image forming apparatus 1 including an image forming portion 80, and an insert apparatus 3 connected to the image forming apparatus 1.

The image forming apparatus 1 includes a user interface 11, through which a user enters a print command such as a copy command. When a print command is entered from the user, a sheet is fed one at a time from a feeding portion 22 that stores a plurality of sheets. Sheets, i.e., recording sheets, used as recording media include various sheet members of various sizes and materials such as paper like normal paper and thick paper; plastic films like overhead projector sheets; special-shaped sheets like envelopes and index paper; and cloth. Recording sheet is typically printing paper, and in the following description, the recording sheet is referred to as "recording paper".

A printer feeding portion 1A serving as a first feeding portion according to the present embodiment is provided in the image forming apparatus 1. The printer feeding portion 1A according to the present embodiment includes three feeding portions 22, 23 and 24 that each feeds recording paper. The feeding portion 22 includes a storage 220, a pickup roller 221 and a feed roller pair 222. The storage 220 includes a lift plate that is lifted and lowered by a lifter motor 202 (FIG. 2) and a sheet surface sensor 226, wherein the position of the lift plate is controlled so that an uppermost recording paper is in contact with the pickup roller 221.

The pickup roller 221 sends the uppermost recording paper of the storage 220 to the feed roller pair 222. The feed roller pair 222 is a pair of rollers composed of an upper roller and a lower roller, wherein the upper roller rotates in a forward direction and the lower roller rotates in a backward direction, by which the recording paper is separated one by one and fed.

A feed sensor 223 is arranged downstream of the feed roller pair 222 in a conveyance direction of recording paper from the storage 220 toward the image forming portion 80. The image forming apparatus 1 confirms whether an uppermost recording paper has been picked up at a predetermined timing using the feed sensor 223. If the feed sensor 223 is not turned ON, that is, if the sensor does not detect the recording paper even after a predetermined time has elapsed from the starting of pickup of recording paper by the pickup roller 221, it is determined that pickup of recording paper has failed, and the conveyance operation is stopped. Further, if the trailing edge of the recording paper does not pass the feed sensor 223 and the output of the sensor is not turned OFF even after elapse of a predetermined time from starting of pickup of recording paper, it is determined that the recording paper is stuck and not conveyed correctly, the state of which is hereinafter referred to as "stuck jam", and the conveyance operation is stopped. The recording paper that has passed the feed roller pair 222 is conveyed to a vertical path roller 101 of a vertical path 501.

Similarly, the feeding portions 23 and 24 are configured to respectively feed the recording paper stored in the storages 230 and 240 one by one by the pickup roller 221 and the feed roller pair 222. The positions of the uppermost recording paper in the storages 230 and 240 are controlled based on the detection result of the sheet surface sensor 226. The sheets fed from the feeding portions 23 and 24 are respectively conveyed via conveyance rollers 107 and 108 toward the vertical path roller 101. The feed sensors 233 and 243 monitor whether recording paper has been fed normally from the respective feeding portions 23 and 24.

Recording paper that has passed through a path sensor 102 by the vertical path roller 101 is guided along a horizontal path 502 on which the image forming portion 80 is arranged, and image is formed thereto by the image forming portion 80. The image forming portion 80 is an electrophotographic unit adopting an intermediate transfer system, which is equipped with four drums 801, 802, 803 and 804 and an intermediate transfer belt 805. The drums 801 to 804 are photosensitive members in the shape of a drum, and when the image forming portion 80 performs an image forming operation, a toner image is formed on the surface of each of the drums 801 to 804 by the electrophotographic process. That is, after having the surface of the rotating drum charged uniformly by a charging unit, an exposing unit irradiates light based on an image information, by which an electrostatic latent image is formed on the drum surface. The electrostatic latent image is developed by toner supplied from the developing unit and visualized as toner image. The toner images borne on the drums 801 to 804 are primarily transferred to the intermediate transfer belt 805 serving as an intermediate transfer body, and then secondarily transferred to the recording paper at a secondary transfer portion formed between the intermediate transfer belt 805 and the secondary transfer roller 806.

A pre-registration sensor 103, a pre-registration roller 104, a registration roller 105 and a registration sensor 106 are provided on the horizontal path 502. A drive start timing and a driving speed and the like of each of the rollers 104 and 105 are controlled based on the timing at which the corresponding sensor 103 or 106 detects the recording paper. Thereby, positioning (registration) in the sheet conveyance direction of an image secondarily transferred to the recording paper at the secondary transfer portion with respect to the leading edge, that is, downstream end in the sheet conveyance direction, of the recording paper, is carried out. According to such positioning of a leading edge of the transfer image and the recording paper, a configuration is widely known that drives the registration roller 105 based on the signal synchronized with image formation.

The image transferred to the recording paper is subjected to a fixing process by passing through a fixing portion 13. The fixing portion 13 includes a rotary member pair that nips the recording paper and a heating element such as a halogen lamp, and an image on the recording paper is pressed and heated while the recording paper is conveyed. Thereby, toner particles are melted and fixed, by which an image fixed on the recording paper is obtained.

Recording paper on which the image has been fixed is conveyed by the sheet discharge roller 151 toward the insert apparatus 3. Whether transfer to the insert apparatus 3 has been completed at a predetermined timing is confirmed by a sheet discharge sensor 152. If passing of the recording paper is not detected by the sheet discharge sensor 152 even when a predetermined time has elapsed, it is determined that stuck jam has occurred where a recording paper is retained, and the conveyance operation is stopped.

Further, a temperature and humidity sensor 400 has been provided on an exterior portion of the image forming apparatus 1, which enables to measure the temperature and humidity around the apparatus. A printer controller 900 described later determines an environment classification of the circumference of the apparatus body based on the temperature and humidity detected by the temperature and humidity sensor 400. There are three environment classifications, which are "low-temperature low-humidity environment", hereinafter referred to as LL environment, "medium-temperature low-humidity environment", hereinafter referred to as NL environment, and "high-temperature high-humidity environment", hereinafter referred to as HH environment.

The image forming portion 80 described above is an example of an image forming portion for forming an image on a recording paper, and it can be replaced with, for example, a direct transfer-type electrophotographic unit for transferring an image directly from the photosensitive member to the recording paper, or with an inkjet-type image forming portion. Further, a configuration can be adopted where the image forming apparatus 1 includes a plurality of storages including the above-described storage 220 as a first feeding portion, or where an option feeder for feeding recording paper stored in the storage to the image forming apparatus 1 is connected to the image forming apparatus 1.

Insert Apparatus

The insert apparatus 3 includes an inlet roller 301, an inlet sensor 311, a horizontal path 340, a sheet discharge roller 302, a sheet discharge sensor 312 and a sheet discharge tray 350. The horizontal path 340 is connected to the horizontal path 502 of the image forming apparatus 1, and it is extended in the insert apparatus 3 in an approximately horizontal direction when viewed from a front side of the image forming system 1S, that is, in the viewpoint of FIG. 1. The horizontal path 340 is a sheet conveyance path configured to convey the recording paper on which the image has been formed by the image forming portion 80. The inlet roller 301 and the inlet sensor 311 are arranged at an upstream end portion of the horizontal path 340 in a sheet conveyance direction of the horizontal path 340, that is, from right to left in the drawing, and the sheet discharge roller 302 and the sheet discharge sensor 312 are arranged at a downstream end portion of the horizontal path 340. The sheet discharge tray 350 is arranged on a side portion on an opposite side from the image forming apparatus 1 in the horizontal direction.

The recording paper on which the image has been formed in the image forming apparatus 1 is transferred via the sheet discharge roller 151 to an opening portion of the horizontal path 340 of the insert apparatus 3. When it is determined by the inlet sensor 311 that the recording paper discharged from the image forming apparatus 1 has entered the insert apparatus 3, the inlet roller 301 is driven and the recording paper is conveyed toward the horizontal path 340. If the recording paper passes the sheet discharge roller 302, the recording paper is discharged directly to the sheet discharge tray 350. The sheet discharge sensor 312 is a sensor for detecting that the recording paper or the inserting paper described later has been normally discharged to the sheet discharge tray 350.

A configuration for conveying the recording paper to which image has been formed in the image forming apparatus 1 has been described. Now, a configuration for conveying the inserting sheet in the insert apparatus 3 will be described.

An inserting sheet denotes a sheet that is inserted by the insert apparatus 3 to be included in a bundle of sheets (which may be sheets formed into a book through bookbinding) output as a product from the image forming system 1S, and that is other than the recording paper among the bundle of sheets to which image has been formed in the image forming apparatus 1. The inserting sheet includes paper that is inserted as a mark for indicating the number of sheets that is inserted each time a predetermined number of recording paper has been output, or inserted to prevent unwanted transfer of image, which is generally referred to as slip sheet or interleaf. Further, an inserting sheet includes a sheet that constitutes a part of a final product together with the recording paper to which image has been formed in the image forming apparatus 1, such as a cover, back cover and a middle leaf cover, or a page prepared by separate printing to be inserted to the recording paper on which the image has been formed in the image forming apparatus 1. In the following description, the inserting sheet fed from the insert apparatus 3 is denoted as "inserting paper", in comparison to recording paper. Similar to the transfer paper, the inserting paper can be a sheet member other than paper.

The insert apparatus 3 is equipped with an inserter feeding portion 3A that feeds an inserting paper supported on a sheet feed tray to the horizontal path 340 to which recording paper on which the image has been formed in the image forming apparatus 1 is conveyed. According to the present embodiment, a plurality of, two according to the present example, sheet feed trays are provided. Considering the feeding portion 22 as the first feeding portion of the image forming apparatus 1, the inserter feeding portion 3A serves as a second feeding portion.

The inserter feeding portion 3A includes an upper feed tray 320 and a lower feed tray 321 arranged below the upper feed tray 320, and feeds inserting paper from any of the trays and conveys the same to the horizontal path 340. In other words, two trays serving as a plurality of supporting portions are provided to the inserter feeding portion according to the present embodiment. The upper feed tray 320 is an example of the first supporting portion, and the lower feed tray 321 is an example of the second supporting portion.

Feed rollers 303 and 304 and separation rollers 305 and 306 corresponding to each tray are provided on the inserter feeding portion 3A. Further, the inserter feeding portion 3A includes an upper feed path 331, a lower feed path 332, a merge-standby path 330, a conveyance roller 307 and a registration roller 308.

The inserting paper supported on the upper feed tray 320 or the lower feed tray 321 is fed sequentially from an uppermost paper by feed roller 303 or 304. The separation rollers 305 and 306 arranged respectively downstream of the feed rollers 303 and 304 are conveyance rollers each in contact with a pad-shaped separation member. The separation rollers 305 and 306 each separates and conveys the inserting paper received from the feed roller 303 or 304 one sheet at a time. The feeding of the inserting paper from the upper feed tray 320 is detected by an upper tray feed sensor 313, and the feeding of the inserting paper from the lower feed tray 321 is detected by a lower tray feed sensor 314.

The inserting paper fed from the upper feed tray 320 is conveyed via the upper feed path 331, and the inserting paper fed from the lower feed tray 321 is conveyed via the lower feed path 332. The upper feed path 331 and the lower feed path 332 are merged at a downstream end in the sheet conveyance direction, into a merge-standby path 330 communicated to the horizontal path 340. The upper feed path 331 is a first conveyance path according to the present embodiment, the lower feed path 332 is a second conveyance path according to the present embodiment, and the merge-standby path 330 is a third conveyance path according to the present embodiment.

The inserting paper sent into the merge-standby path 330 is conveyed by the conveyance roller 307 arranged on the merge-standby path 330, and the inserting paper stands by in a state where the leading edge is abutted against the registration roller 308 in a stopped state. By having the leading edge abut against the registration roller 308 in the stopped state, the inserting paper is bent, that is, the paper forms a loop, by which inclination of the inserting paper that was caused when the inserting paper was set to the upper feed tray 320 and skewing of the inserting paper that was caused during feed operation are corrected. After the leading edge of the inserting paper is detected by a registration sensor 315 arranged on the merge-standby path 330, driving of the separation roller 305 is stopped at a timing set in advance to form a loop of a predetermined size to the inserting paper abutting against the registration roller 308. Thereafter, the driving of the registration roller 308 and the separation roller 305 is started based on a timing signal that the insert apparatus 3 receives from the image forming apparatus 1, and the inserting paper is pulled into the horizontal path 340 via a merging portion C1 of the merge-standby path 330 and the horizontal path 340. Then, inserting paper is discharged by the sheet discharge roller 302 to an exterior of the insert apparatus 3, and it is stacked together with recording paper to which the image has been formed in the image forming apparatus 1 onto the sheet discharge tray 350.

The insert apparatus 3 includes an upper-tray inserting paper presence sensor 721 and a lower-tray inserting paper presence sensor 722 serving as a detection portion for detecting the presence of sheets on a plurality of supporting portions provided in the insert apparatus. The upper-tray inserting paper presence sensor 721 serves as a first detection unit of the present embodiment, and the lower-tray inserting paper presence sensor 722 serves as a second detection unit of the present embodiment. A sensor that optically detects presence of the inserting paper can be used as the upper and lower tray inserting paper presence sensors 721 and 722. For example, a photo-reflector including a light emitting component for irradiating detection light upward above the upper feed tray 320 and a photosensing portion for detecting reflected light from an object, wherein output signal of the photosensing portion is changed by the presence or absence of inserting paper on the tray, can be used as the upper-tray inserting paper presence sensor 721.

When inserting paper is set to the upper feed tray 320, the upper-tray inserting paper presence sensor 721 outputs a signal indicating that inserting paper has been detected, so that a controller, corresponding to an inserter controller described later, of the insert apparatus 3 determines that "paper is present on upper tray". If inserting paper is not set on the upper feed tray 320, or if inserting paper being set has been removed, the upper-tray inserting paper presence sensor 721 outputs a signal indicating that inserting paper is not detected, so that the inserter controller determines that "paper is not present on upper tray". As for the lower feed tray 321, the inserter controller determines the presence or absence of inserting paper based on the detection result of the lower-tray inserting paper presence sensor 722. The result of determination of presence/absence of inserting paper on each tray by the inserter controller is notified to the image forming apparatus 1 through a communication circuit.

The upper-tray inserting paper presence sensor 721 and the lower-tray inserting paper presence sensor 722 each detects whether at least one sheet is present on the corresponding tray at a predetermined detection position in the sheet conveyance direction. Therefore, even if the uppermost inserting paper set to the upper feed tray 320 or the lower feed tray 321 is fed to a predetermined position, if the inserting paper presence sensor of the tray is detecting a sheet, it can be recognized that at least one inserting paper other than the uppermost inserting paper is present. The predetermined position is a position where the trailing edge of the inserting paper in the sheet conveyance direction is positioned further downstream in the sheet conveyance direction than the detection position of the inserting paper presence sensor. As described later, in a state where the inserting paper presence sensor 721 or 722 has detected inserting paper in a state where the uppermost inserting paper has been moved to the predetermined position, the inserter controller notifies that "paper is present on upper tray" regarding inserting paper to be inserted after the uppermost inserting paper to the image forming apparatus 1.

In the present embodiment, the final product of the image forming system 1S is described as being supported on the sheet discharge tray 350 of the insert apparatus 3. However, the image forming system 1S may be equipped with a sheet processing apparatus that performs processing such as a binding process or a bookbinding process to recording paper to which an image has been formed in the image forming apparatus 1 or a stacker capable of supporting a large amount of products. In this case, the sheets discharged from the insert apparatus 3 is discharged to a discharge portion provided on a unit other than the insert apparatus 3, or the recording paper to which image has been formed in the image forming apparatus 1 may be received by the insert apparatus 3 via a relay unit. The configuration described below is applicable regardless of whether a functional unit other than the insert apparatus 3 is included in the image forming system 1S.

Figure 2:
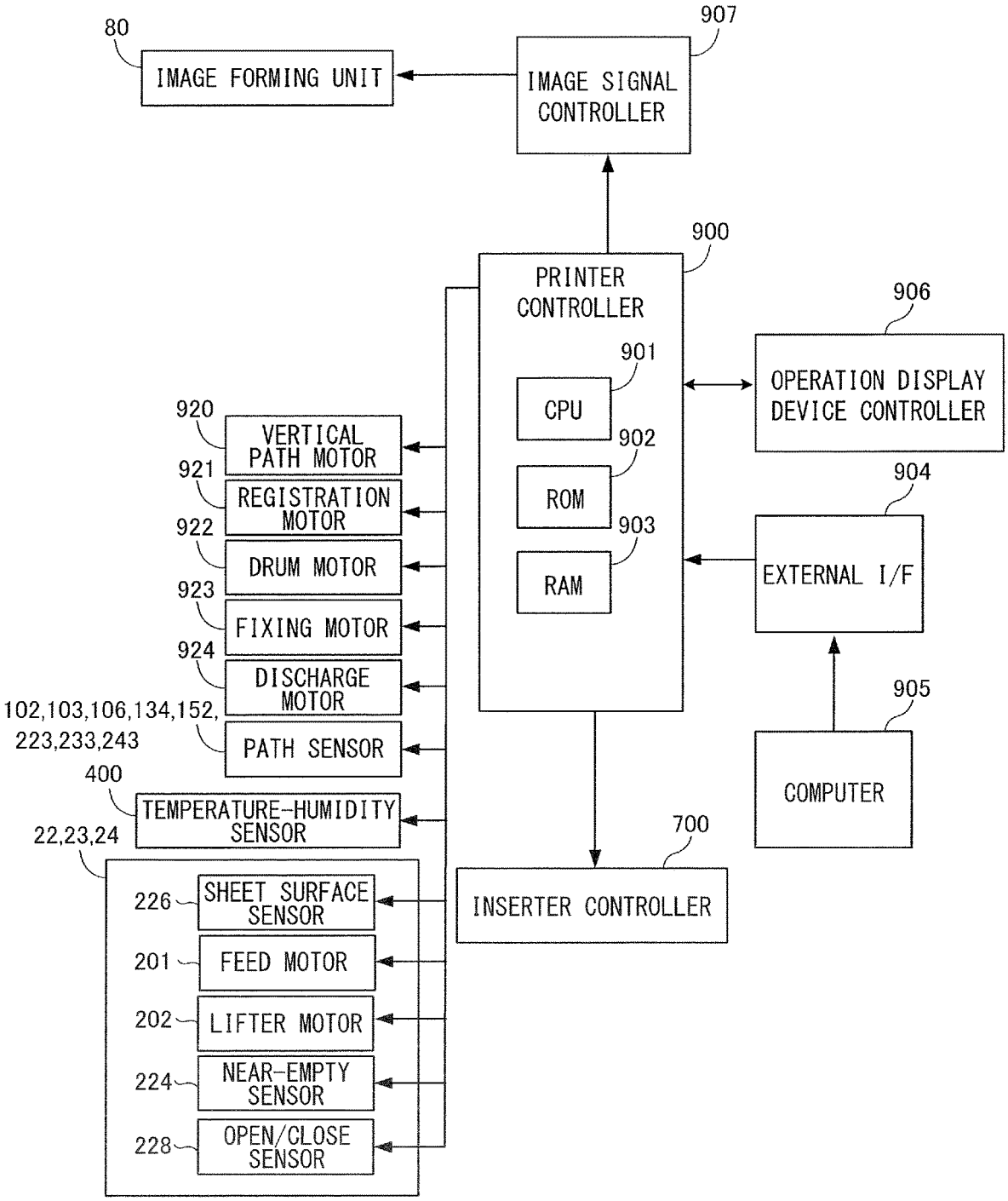
FIG. 2 is a block diagram of the image forming system according to the first embodiment.

FIG. 2 is a block diagram illustrating a configuration of a controller that manages control of the whole image forming system 1S according to the present embodiment. The controller serving as a controller of the image forming system 1S according to the present embodiment includes a printer controller 900 provided on the image forming apparatus 1 and an inserter controller 700 provided on the insert apparatus 3.

The printer controller 900 includes a CPU (Central Processing Unit) 901, a ROM (Read Only Memory) 902, and a RAM (Random Access Memory) 903. The CPU 901 serving as an execution unit of programs reads and executes a control program stored in the ROM 902, and controls the image forming apparatus 1 extensively by cooperating with an image signal controller 907 and an operation display device controller 906. The ROM 902 is an example of a nonvolatile memory storing control programs and data necessary for controlling the apparatus using the control program and includes a storage area capable of rewriting the contents of the storage, such as a storage area of EEPROM.

The RAM 903 is used for temporarily saving control data or as a work area of operation processing accompanying control. The image signal controller 907 performs various processes to the digital image signals entered from an external computer 905 via an external interface (I/F) 904 and converts the digital image signal to video signal and outputs the same to the image forming portion 80. In the image forming portion 80, exposure processing of the drums 801 to 804 (FIG. 1) is performed based on the video signal to form electrostatic latent images corresponding to respective color components of the digital image signal on the respective drum surfaces.

The operation display device controller 906 controls the user interface 11 illustrated in FIG. 1 and communicates information with the printer controller 900. The user interface 11 includes an input device such as a plurality of keys for setting various functions related to image formation and a touch panel function unit on a display, and a display device for displaying information indicating a setting state such as a liquid crystal display. The user interface 11 outputs a key signal corresponding to an operation of a key to the printer controller 900 and displays corresponding information on a display unit based on the signal from the printer controller 900.

Next, a main sheet conveyance drive system of the image forming apparatus 1 is described with reference to FIGS. 1 and 2. A feed motor 201 for driving the pickup roller 221, and a vertical path motor 920 for driving the feed roller pair 222, the conveyance rollers 107 and 108 and the vertical path roller 101 are provided as driving sources from the feeding portions 22, 23 and 24 to the vertical path 501. A registration motor 921 for driving the pre-registration roller 104 and the registration roller 105 is provided as a driving source from the horizontal path 502 to the secondary transfer portion. A drum motor 922, a fixing motor 923 and a discharge motor 924 are provided as driving sources from the secondary transfer portion to the discharge portion. The drum motor 922 drives the drums 801 to 804 of the image forming portion 80, the intermediate transfer belt 805 and the secondary transfer roller 806. The fixing motor 923 drives the fixing portion 13. The discharge motor 924 drives the sheet discharge roller 151.

In addition, the image forming apparatus 1 includes path sensors (102, 103, 106, 134, 152, 223, 233 and 243) provided on various areas of the conveyance path as sensors for detecting the conveyance state of the recording paper. Prefixture path sensor 134 (refer to FIG. 1) is a sensor that detects recording paper positioned between the secondary transfer portion and the fixing portion 13, especially at a position immediately before the fixing portion. By receiving input signals from these sensors, the printer controller 900 monitors whether recording paper has been conveyed as scheduled, that is, whether jam has not occurred.

In addition to the sheet surface sensor 226, the feed motor 201 and the lifter motor 202, the feeding portions 22, 23 and 24 are each equipped with a near-empty sensor 224 and an open/close sensor 228. For example, the near-empty sensor 224 is a sensor that detects that the lift plate in the storage being lifted and lowered by the lifter motor 202 is lifted to a predetermined height, and outputs a detection signal that indicates that a remaining amount of recording paper within the storage has fallen below a predetermined amount. Further, the open/close sensor 228 is a sensor that detects whether the corresponding storage is inserted to a predetermined position in the apparatus body of the image forming apparatus 1, that is, in a closed state, or the corresponding storage is drawn out from the apparatus body, that is, in an opened state.

Figure 3:
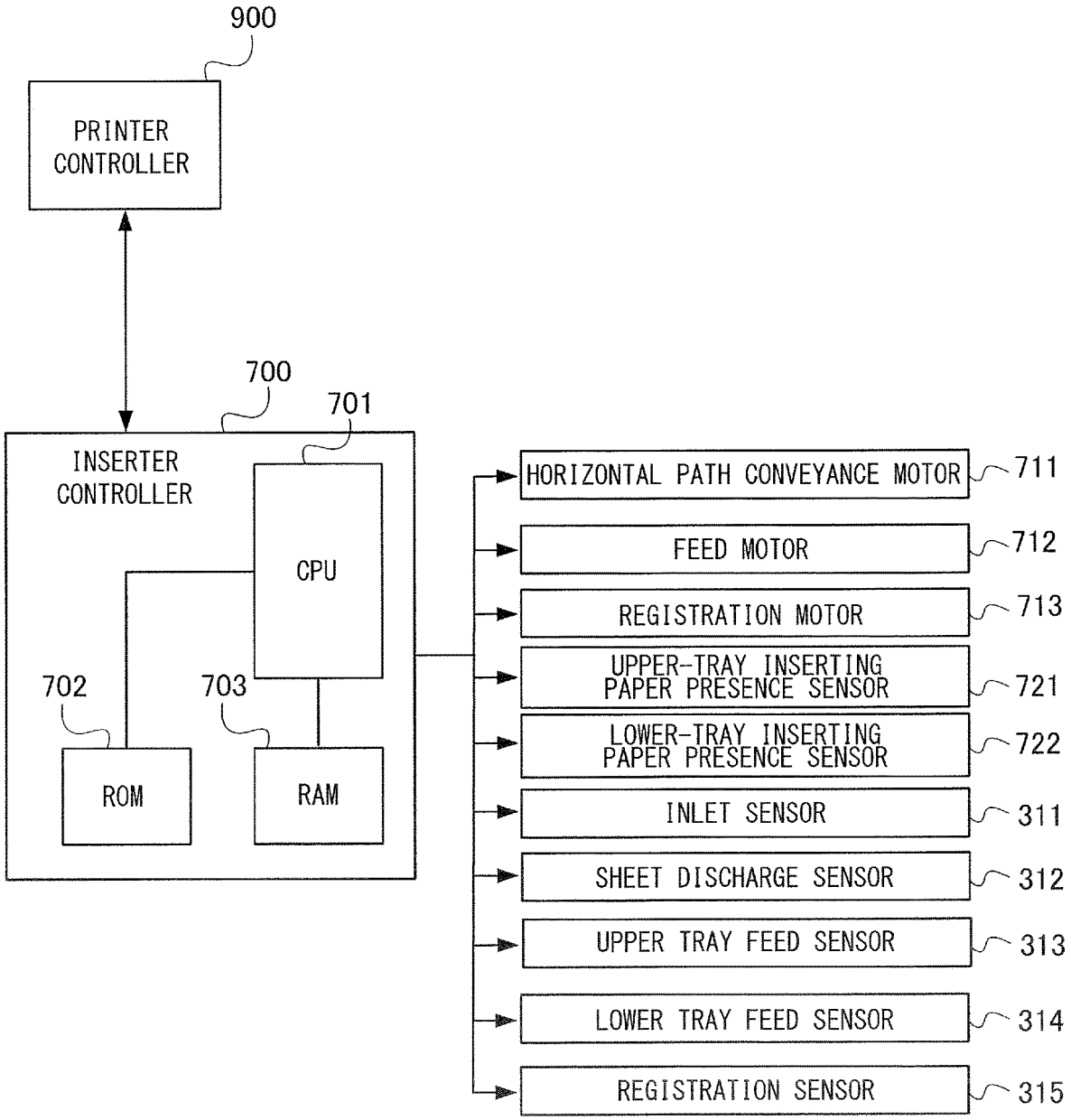
FIG. 3 is a block diagram of an inserter controller according to the first embodiment.

Next, the inserter controller 700 will be described with reference to FIG. 3. The inserter controller 700 includes a CPU 701, a ROM 702 and a RAM 703. The CPU 701 controls the insert apparatus 3 by reading and executing a control program stored in the ROM 702. The RAM 703 is used to temporarily save control data or as a work area of operation processing accompanying control. The inserter controller 700 can perform bilateral communication with the printer controller 900, receiving operation commands from the printer controller 900 and sending a notice related to the operation state of the insert apparatus 3 to the printer controller 900.

The inserter controller 700 and the printer controller 900 that cooperate with each other serve as a controller that controls the image forming system 1S according to the present embodiment. The ROM 702 and 902 storing the control programs to be executed by the CPU 701 and 901 of the respective controllers are examples of non-transitory storage media storing control programs and data for controlling the image forming system.

A main sheet conveyance drive system of the insert apparatus 3 will be described with reference to FIGS. 1 and 3. A horizontal path conveyance motor 711 for driving the inlet roller 301 and the sheet discharge roller 302 are provided as a driving source for receiving recording paper coming from the image forming apparatus 1 and conveying the paper toward the sheet discharge tray 350. A feed motor 712 for driving the feed rollers 303 and 304 and the separation rollers 305 and 306 is provided as a driving source for feeding inserting paper from the upper feed tray 320 and the lower feed tray 321 and performing skew correction at the merge-standby path 330. A registration motor 713 for driving the registration roller 308 is provided as a driving source for conveying inserting paper, after correcting skewing of inserting paper, to the merging portion C1 of the horizontal path 340.

The inserter controller 700 is connected to the above-described sensors 311 to 315 provided on the insert apparatus 3 and determines a conveyance state of the sheet in the insert apparatus 3 based on the detection signals from the respective sensors. Further, the inserter controller 700 notifies the number of inserting paper currently confirmed to be conveyable to the horizontal path 340 to the printer controller 900 based on the detection result of the upper-tray inserting paper presence sensor 721 and the lower-tray inserting paper presence sensor 722.

User Interface

Figure 8:
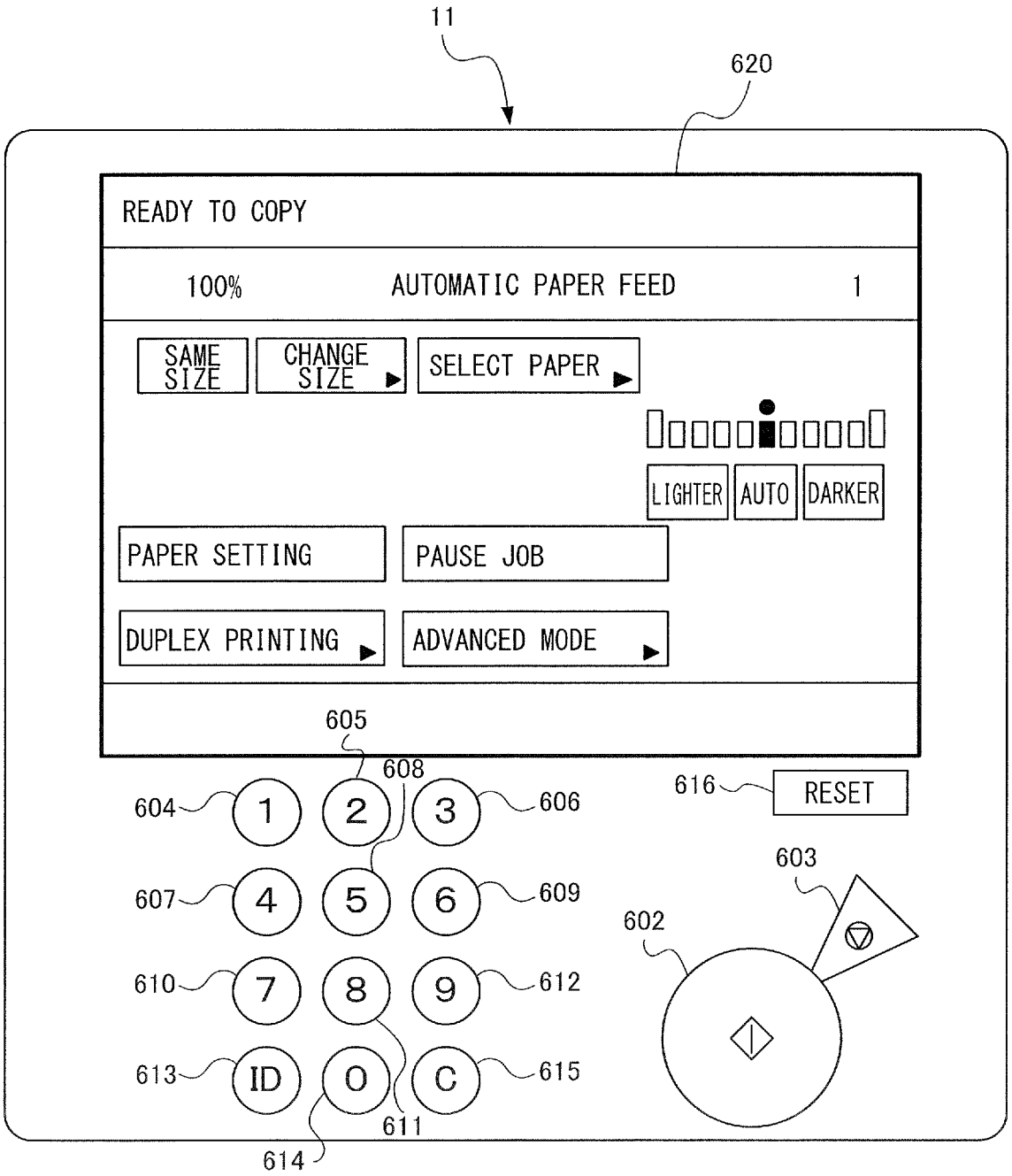
FIG. 8 is a view illustrating a user interface of the image forming system according to the first embodiment.

FIG. 8 illustrates the user interface 11 in the image forming apparatus 1 according to the present embodiment. The user interface 11 includes, for example, a start key 602 for starting the image forming operation, a stop key 603 for interrupting image forming operation, numeric keys 604 to 612 and 614 for performing numerical value settings and the like, an ID key 613, a clear key 615, a reset key 616 and so on. Further, a display unit 620 having a touch panel function on an upper portion is provided, by which a software key can be created on the screen.

The image forming system according to the present embodiment is capable of setting a processing mode such as an insert mode performed using the insert apparatus 3 as an advanced mode. An insert mode is a state of operation in which inserting paper is fed from the insert apparatus 3 and inserted between recording paper on which the image is formed in the image forming apparatus 1 during execution of the image forming job by the image forming system. The setting of such mode is performed by the input operation of the user via the user interface 11, or operation using an operation screen displayed on a display of an external device connected via a network. For example, if an advanced mode key serving as a software key is selected on an initial screen illustrated in FIG. 9A when setting the advanced mode, a menu select screen is displayed on the display unit 620, and setting of the processing mode is performed using the menu select screen. Actual setting of processes will be described later.

Paper Setting of Inserting Paper Set on Sheet Feed Tray

If the user sets inserting paper on the upper feed tray 320 or the lower feed tray 321 of the insert apparatus 3, the user must enter using the user interface 11 information related to the inserting paper being set. Now, a flow for setting up paper setting of inserting paper, such as surface property, shape, grammage and size, will be described with reference to FIG. 9A to 9F.

Figure 9A:
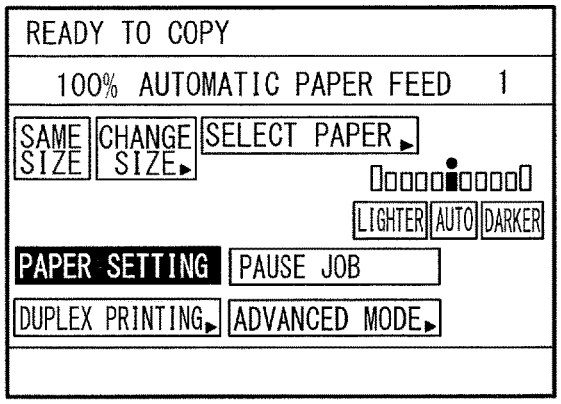
FIG. 9A is an explanatory view illustrating a flow of paper setting according to the first embodiment.
Figure 9B:
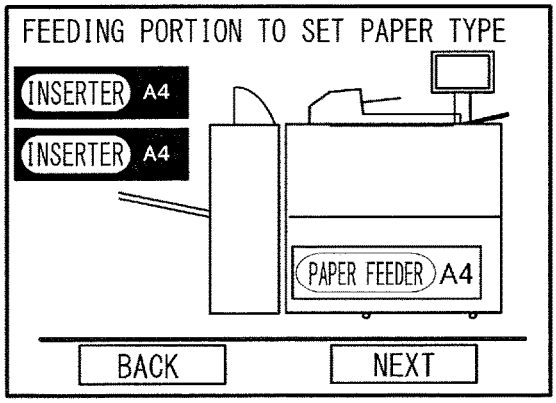
FIG. 9B is an explanatory view illustrating a flow of paper setting according to the first embodiment.

When the user presses a "paper setting" button on the user interface 11 illustrated in FIG. 9A, the state of display of the display unit 620 is changed to a paper setting screen shown in FIG. 9B by the CPU 901. At first, the user selects which sheet supporting portion, i.e., sheet supply, should be subjected to paper setting. Here, the target is selected from the feeding portions 22, 23 and 24 provided on the image forming apparatus 1 or the upper feed tray 320 and the lower feed tray 321 provided on the insert apparatus.

On the select screen on FIG. 9B, if the user wishes to set paper settings for both the upper feed tray 320 and the lower feed tray 321 simultaneously, the user presses a "next" button in a state where both buttons corresponding to the upper feed tray 320 and the lower feed tray 321 are selected. By setting a common paper setting for a plurality of supporting portions provided in the insert apparatus 3, alternate feeding of the inserting paper described later is enabled. In a state where the "next" button is pressed, the display unit 620 moves onto a setting screen of the surface property illustrated in FIG. 9C.

Figure 9C:
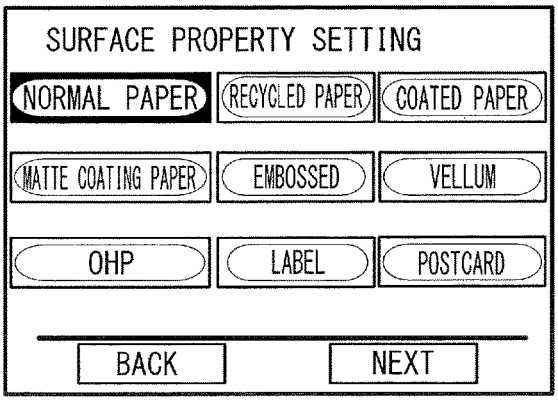
FIG. 9C is an explanatory view illustrating a flow of paper setting according to the first embodiment.

On a surface property setting screen of FIG. 9C, the user selects a surface property of the sheet set to the selected sheet supply. Surface property is a characteristic of the surface of the sheet material, and surface property classifications based on the sheet material, presence/absence and material of coating layer, presence/absence of surface treatment such as embossing finish and the like are prepared in advance. By pressing the "next" button, the display unit 620 transits to a shape setting screen illustrated in FIG. 9D.

Figure 9D:
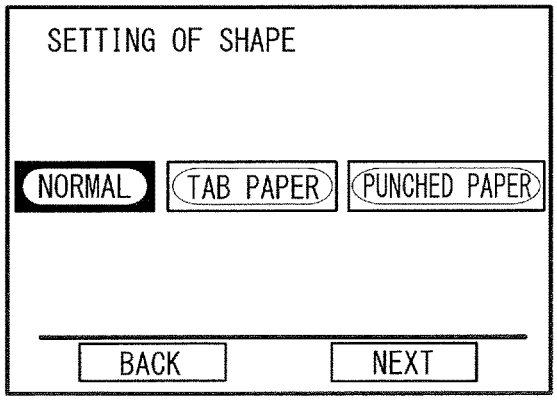
FIG. 9D is an explanatory view illustrating a flow of paper setting according to the first embodiment.

In the shape setting screen of FIG. 9D, the user selects a shape of the sheet. "Normal" denotes that the paper is a normal, rectangular shaped paper, and "tab paper" or "punched paper" denotes a sheet material having different characteristic shapes. By pressing the "next" button, the display unit 620 moves onto a setting screen of grammage illustrated in FIG. 9E.

Figure 9E:
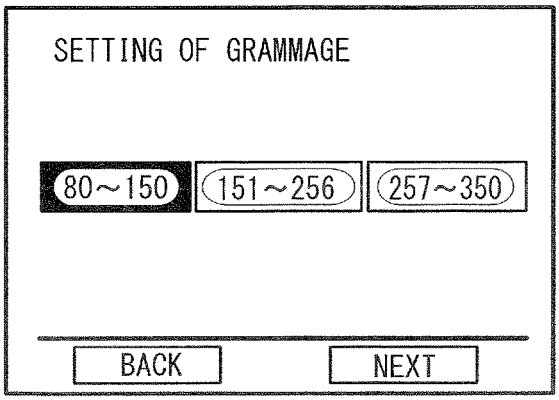
FIG. 9E is an explanatory view illustrating a flow of paper setting according to the first embodiment.

On a grammage setting screen of FIG. 9E, the user selects the grammage of the sheet, that is, sheet weight per unit area [g/m$^2$]. By pressing the "next" button, the display unit 620 transits to a paper size setting screen illustrated in FIG. 9F.

Figure 9F:
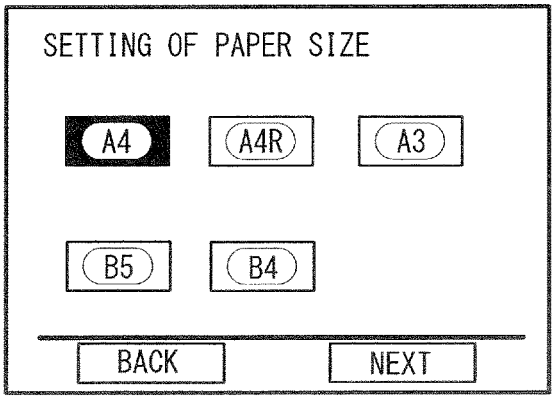
FIG. 9F is an explanatory view illustrating a flow of paper setting according to the first embodiment.

On the paper size setting screen of FIG. 9F, the user selects the size of the sheet. By pressing the "next" button, a series of setting operations of paper settings related to inserting paper placed on the upper feed tray 320 and the lower feed tray 321 is completed, and information set on each screen is stored in the nonvolatile memory of the printer controller 900.

The flow of setting operation of paper settings for only one of the upper feed tray 320 and the lower feed tray 321, or a flow of setting operation of paper settings of the feeding portions 22, 23 and 24 of the image forming apparatus 1 is similar to the above-described setting operation. The choices selectable by the user on each setting screen are changed arbitrarily according to actual configurations of the image forming system.

Method for Setting Insert Mode

Figure 10A:
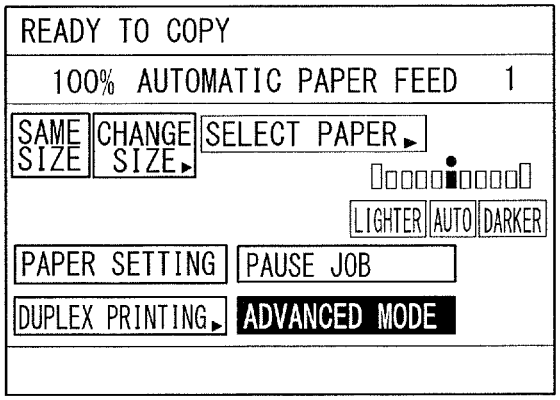
FIG. 10A is an explanatory view illustrating a flow of insert mode setting according to the first embodiment.
Figure 10B:
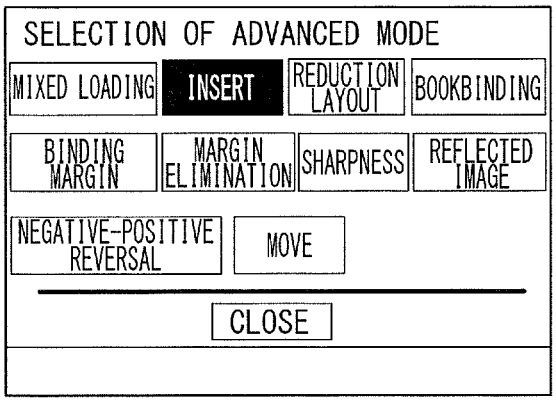
FIG. 10B is an explanatory view illustrating a flow of insert mode setting according to the first embodiment.

Next, a method for setting the insert mode will be described. When the user presses an "advanced mode" button on the initial screen of the user interface 11 illustrated in FIG. 10A, the display unit 620 is switched to a screen for allowing an advanced mode to be selected among a list of advanced modes, as illustrated in FIG. 10B. If an "insert" button is selected, a process of setting the content of the insert mode for performing insert processing of inserting paper when executing the image forming job is started.

Figure 10C:
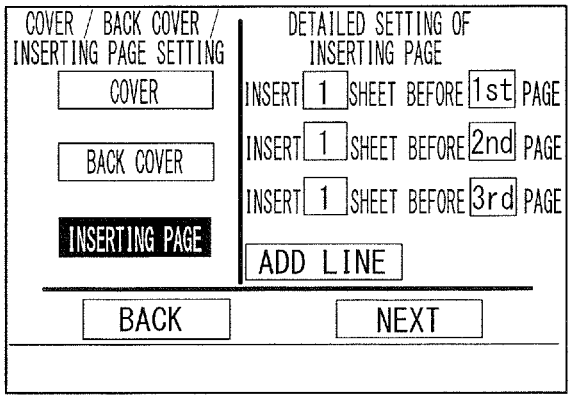
FIG. 10C is an explanatory view illustrating a flow of insert mode setting according to the first embodiment.

As illustrated in FIG. 10C, the display unit 620 moves onto a screen for selecting the purpose of inserting paper among cover, back cover and inserting page. If "inserting page" is selected, it is also possible to simultaneously select how many inserting papers are to be inserted before which page. If "cover" or "back cover" is selected, the page order to which inserting paper is to be inserted is discriminated automatically. If "next" is selected, the display unit 620 moves onto a select screen for sheet supply illustrated in FIG. 10D. In the sheet supply select screen of FIG. 10D, the user selects which sheet supply provided on the insert apparatus 3 from which the insert mode inserts the inserting paper.

Now, in the insert mode, the present embodiment can execute a mode of feeding inserting paper supported on a plurality of supporting portions provided on the insert apparatus 3 by switching the supporting portion serving as the feed source each time the inserting paper is fed. The insert apparatus 3 according to the present embodiment has two supporting portions, so that in the present mode, the feed source of inserting paper is switched alternately between the upper feed tray 320 and the lower feed tray 321. As described, an operation of feeding inserting paper while switching the feed source among the sheet supplies alternately per paper is referred to as "alternate feeding (of inserting paper)", and an operation mode of using the alternate feeding function is referred to as "alternate feeding mode". The alternate feeding mode is a first mode according to the present embodiment, and a state in which the alternate feeding mode is not set, that is, a state where the function of the alternate feeding is not valid, is a second mode according to the present embodiment.

Figure 10D:
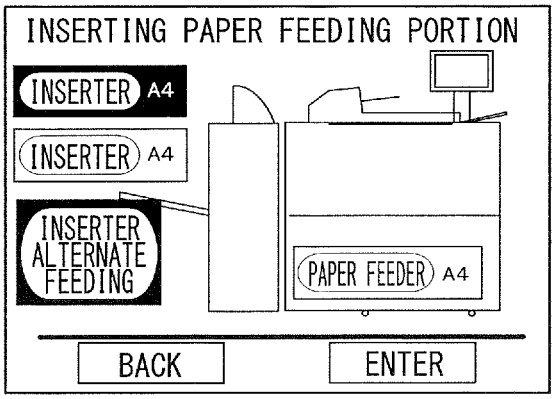
FIG. 10D is an explanatory view illustrating a flow of insert mode setting according to the first embodiment.

If an alternate feeding mode is set, the user selects a sheet supply to be used first and an "inserter alternate feeding" button on the sheet supply select screen on FIG. 10D. Thereafter, if an "enter" key is pressed, a series of setting operations is completed, and information set on each screen is stored in the nonvolatile memory in the printer controller 900. Further, the display unit 620 returns to the initial screen, and the image forming system awaits by for the start key 602 to be pressed and operation to be started.

Sheet Conveyance Operation: When Alternate Feeding is not Performed

Next, the mutual relationship of conveyance timing of inserting paper and recording paper with the insert mode selected will be described in a state where an image forming job, i.e., insert job, is executed. At first, a case where the alternate feeding function of the insert apparatus 3 is invalid will be described. In this case, as long as inserting paper is present on a tray set as current feed source of inserting paper, a process for automatically changing the feed source of inserting paper will not be performed. The operation state of the image forming system in a case where alternate feeding is not performed as described later is a second mode according to the present embodiment.

Figure 4:
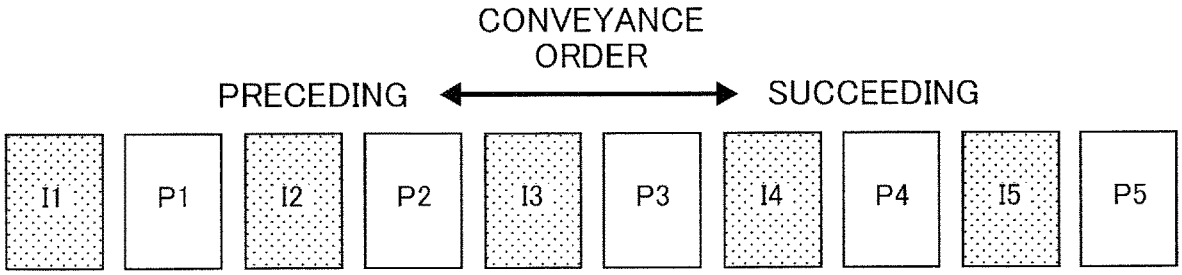
FIG. 4 illustrates an example of page order in an insert job.

In the following description, an example of page order in an insert job as illustrated in FIG. 4 where inserting paper I1 to I5 and recording paper P1 to P5 are alternately arranged is adopted. FIG. 4 illustrates a conveyance order of a sheet at an area where the conveyance paths of inserting paper and recording paper merge. In other words, according to this example, the inserting paper I1 to I5 fed from the insert apparatus 3 and the recording paper P1 to P5 on which the image has been formed in the image forming apparatus 1 alternately pass the merging portion C1 (FIG. 1) on the horizontal path 340 of the insert apparatus 3.

The operation of the insert job of inserting the inserting paper I1 to I5 between every recording paper P1 to P5 will be described for a case where the conveyance direction length of inserting paper is relatively short and a case where the length is relatively long. The upper feed tray 320 is set as the feed source of inserting paper.

Figure 5A:
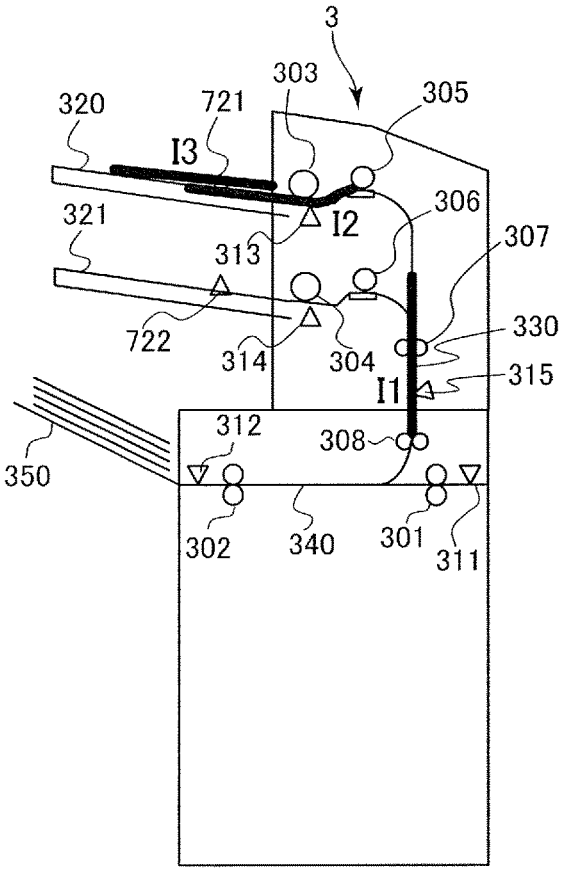
FIG. 5A is a schematic diagram illustrating a state of conveyance operation of inserting paper in a case where alternate feeding is not performed according to the first embodiment.

As illustrated in FIG. 5A, if the length of the inserting paper is relatively short, the image forming apparatus can confirm that at least three inserting papers are present while executing the insert job. That is, if the second inserting paper I2 is moved downstream in the conveyance direction to a predetermined position in a state where the first inserting paper I1 is conveyed to the merge-standby path 330, the upper-tray inserting paper presence sensor 721 will be able to detect the third inserting paper I3. Therefore, in the state illustrated in FIG. 5A, the image forming apparatus 1 is capable of starting feed of the recording paper P3 whose last preceding page is the third inserting paper I3.

A "last preceding page" of a certain sheet denotes a recording paper or an inserting paper that precedes immediately prior to a certain sheet in a conveyance order of the sheets in the sheet conveyance path where the conveyance paths of the recording paper and the inserting paper are merged. Further, "start of feeding" of recording paper denotes start of a series of feeding processes, i.e., feeding sequence, including an operation of feeding recording paper from a designated one among the feeding portion 22, 23 and 24 to the image forming portion 80 and an operation of forming an image on that recording paper by the image forming portion 80. If the conveyance path from the feeding portion to the image forming portion 80 is short, there may be a case where the recording paper starts moving from the storage after the forming of latent image at the image forming portion 80 is started. Even in that case, conveyance timing of the recording paper is set based on the start of the feed sequence, that is, a timing at which formation of latent image is started, so that the starting of feed sequence is set as the start of feeding of recording paper.

Figure 6A:
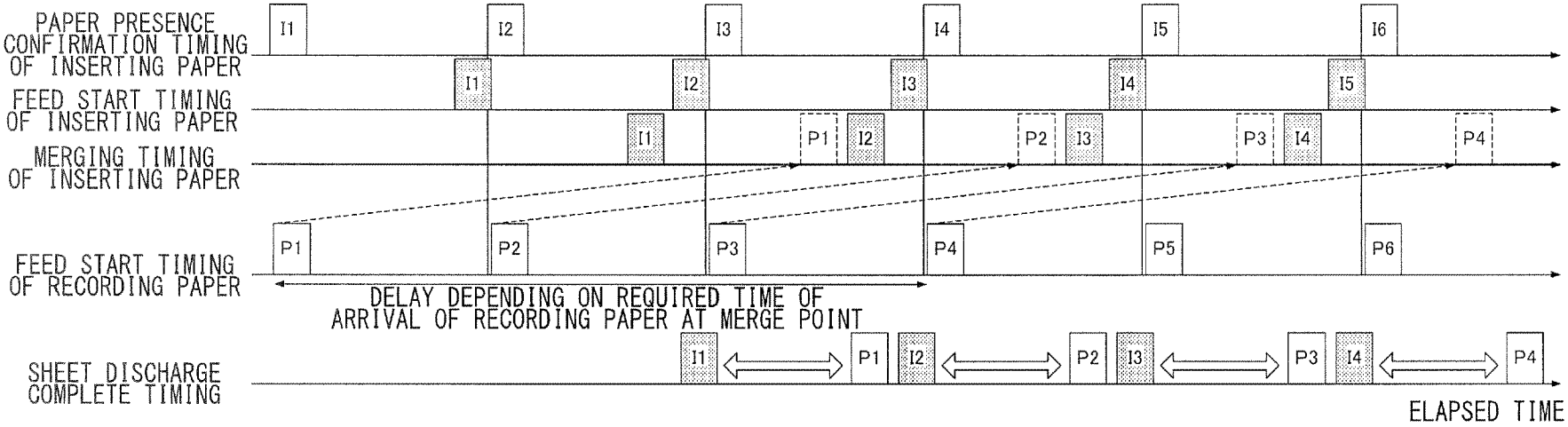
FIG. 6A is a conveyance timing chart of inserting paper and recording paper in a case where alternate feeding is not performed and the length of inserting paper is relatively short according to the first embodiment.

The conveyance timing of a case where the length of inserting paper is relatively short is shown in FIG. 6A. In a state where the paper presence of the inserting paper I1 is confirmed, that is, if the upper-tray inserting paper presence sensor 721 is in a state detecting the sheet when starting the job, it is determined that feeding of recording paper P1 can be carried out, and feeding is started. Feeding of the inserting paper I1 which is the last preceding page of the recording paper P1 is started so as to be carried into the horizontal path until the recording paper P1 reaches the merging position of the horizontal path 340. In a case where recording paper is fed from any one of the feeding portions 22, 23 and 24, the length of conveyance path from the feeding portion to the merging position is set to be longer than the difference of sheet length compared to the length of conveyance path from the upper feed tray 320 to the merging position. Therefore, on the actual timeline, feeding of the inserting paper I1 serving as the last preceding page of the recording paper P1 is started after the feeding of the recording paper P1 is started.

In a state where the inserting paper I1 is conveyed downstream of the detection position of the upper-tray inserting paper presence sensor 721, paper presence of the inserting paper I2 is confirmed. Then, it is determined that feeding of recording paper P2, the last preceding page of which is the inserting paper I2, is possible, and feeding is started. The inserting paper I2 is conveyed to the merge-standby path 330 and set to standby, and after the recording paper P1 serving as the last preceding page passes the merging position, the inserting paper I2 is carried into the horizontal path 340 at a predetermined timing, i.e., merging timing, before the recording paper P2 reaches the merging position of the horizontal path 340.

In a state where the inserting paper I2 is conveyed downstream of the detection position of the upper-tray inserting paper presence sensor 721, paper presence of the inserting paper I3 is determined. Then it is determined that feeding of recording paper P3, the last preceding page of which is the inserting paper I3, is possible, and feeding is started. Hereafter, similarly, the feeding of recording paper P4, P5 and P6 is started after confirming presence of inserting paper I4, I5 and I6 respectively serving as last preceding page.

As shown in FIG. 6A as "discharge complete timing", there is a certain interval, i.e., sheet-to-sheet interval, between discharge of inserting paper and recording paper from the insert apparatus 3. This is because feeding of recording paper is not started until presence of inserting paper serving as last preceding page is confirmed. For example, if feeding of recording paper P4 is to be started, the presence of inserting paper I4 serving as the last preceding page must be confirmed. However, the presence of inserting paper I4 is confirmed only after a series of events has occurred, which are start of feeding of recording paper P1, passing of merging position by recording paper P1, merging of inserting paper I2 to the horizontal path, and passing of predetermined position of inserting paper I3. That is, a delay time from the start of feeding of recording paper P1 to start of feeding of recording paper P4 is conditioned by a required time from feeding of recording paper P1 to the passing of merging position in the insert apparatus 3. In a mode where alternate feeding of inserting paper is not performed, there is a case where the productivity of the image forming system may be deteriorated by the conveyance interval between sheets during an insert job being elongated as the required time for conveying the recording paper to the merging position increases.

Figure 6B:
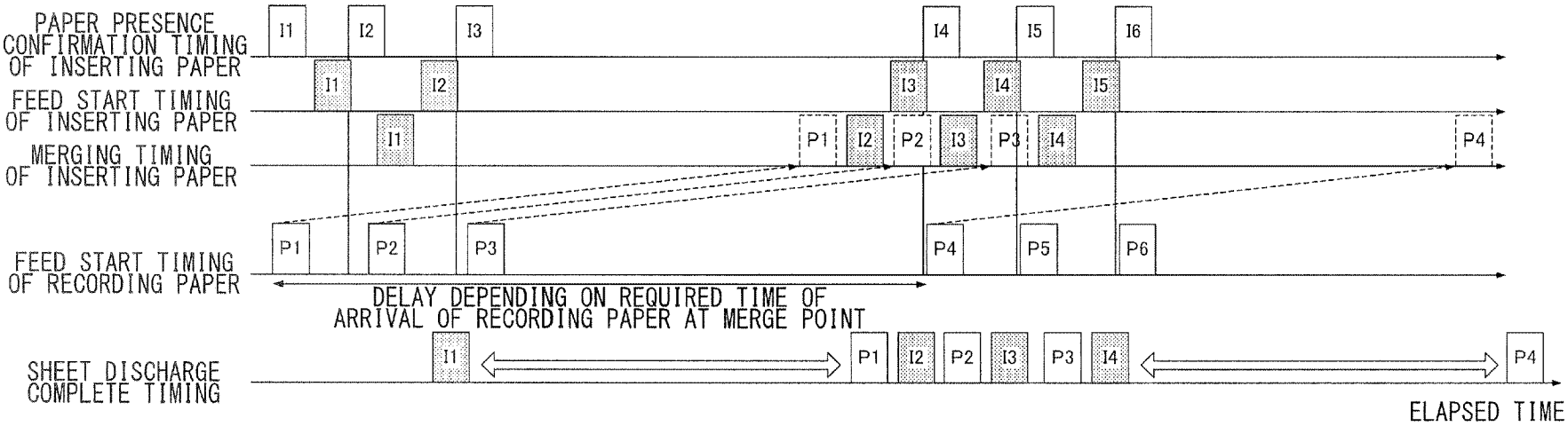
FIG. 6B is a conveyance timing chart of inserting paper and recording paper in a case where alternate feeding is not performed and the length of inserting paper is relatively short according to the first embodiment.

As illustrated in FIG. 6B, if inserting paper I1 is carried into the horizontal path 340 as fast as possible after starting of a job, the timing for starting feeding of inserting paper I2 can be made faster, and the timing for determining paper presence of inserting paper I3 is also made faster. In that case, the start of feeding of recording paper P3 whose last preceding page is inserting paper I3 can be made faster compared to the example illustrated in FIG. 6A. However, the fact that paper presence of inserting paper I4 is confirmed only after a series of events has occurred, which are the start of feeding of recording paper P1, passing of merging position by recording paper P1, merging of inserting paper I2 to the horizontal path, and passing of predetermined position of inserting paper I3, is similar to the case of FIG. 6A. Therefore, the delay until recording paper P4, whose last preceding page is inserting paper I4, can be fed is the same as the delay of FIG. 6A. In other words, the position in which a long sheet-to-sheet interval occurs differs, but the productivity of the insert job being deteriorated based on the length of required time for recording paper to be conveyed to the merging position is the same as the case of FIG. 6A.

Figure 5B:
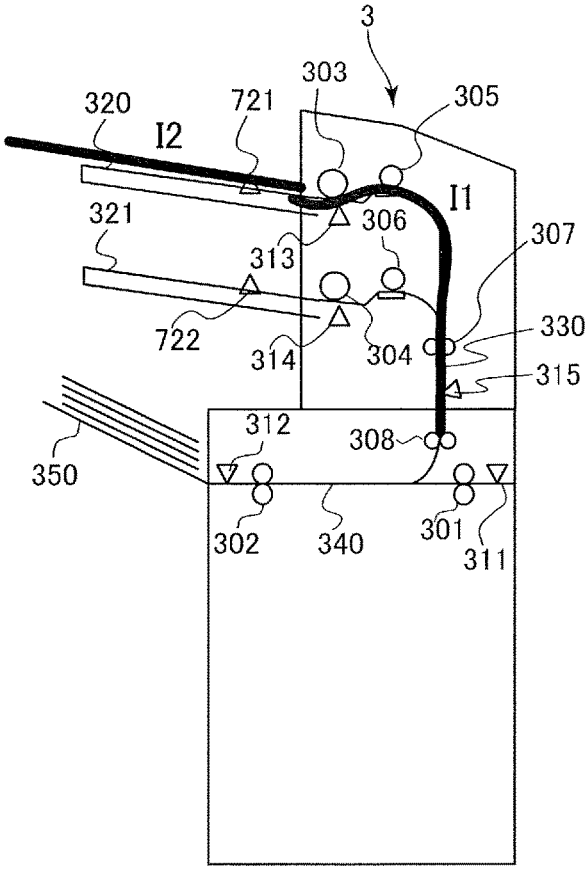
FIG. 5B is a schematic diagram illustrating a state of conveyance operation of inserting paper in a case where alternate feeding is not performed according to the first embodiment.
Figure 7A:
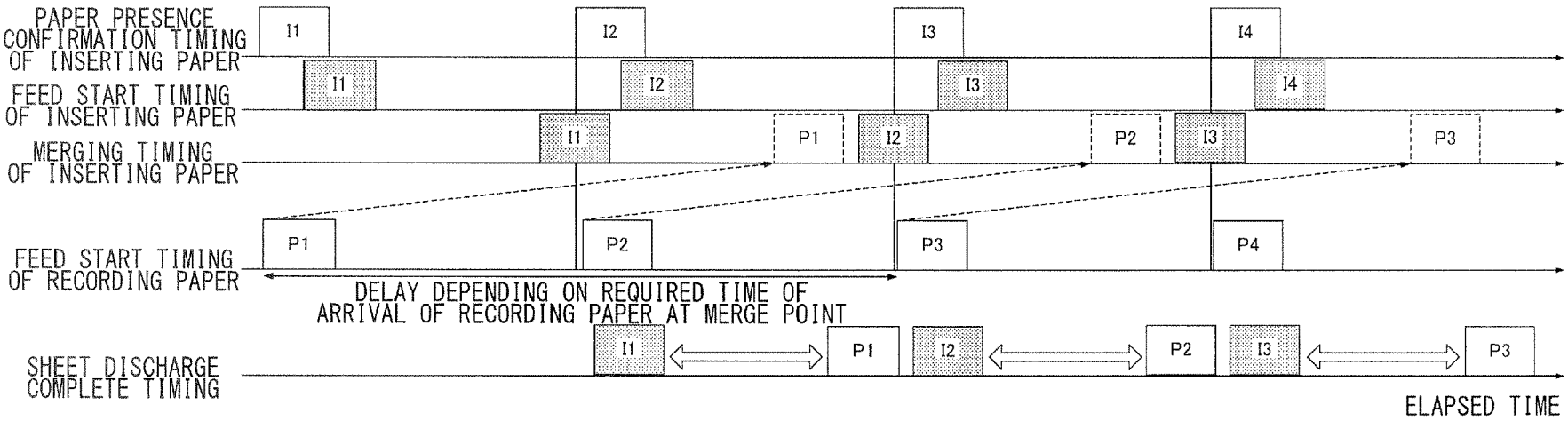
FIG. 7A is a conveyance timing chart of inserting paper and recording paper in a case where alternate feeding is not performed and the length of inserting paper is relatively long according to the first embodiment.

Further, as illustrated in FIG. 5B, there is a case where the length of inserting paper is relatively long, so that paper presence of next inserting paper I2 can only be confirmed after inserting paper I1 has been carried into the horizontal path 340 in the inserter. The feed timing of recording paper in this case is as illustrated in FIG. 7A. If paper presence of inserting paper I1 is confirmed at the time the job is started, it is determined that feeding of recording paper P1 whose last preceding page is inserting paper I1 is possible, so the feeding of recording paper P1 is started.

Feeding of inserting paper I1 is started after feeding of recording paper P1 has been started, and in a state where inserting paper I1 is still at standby at the merge-standby path 330, paper presence of inserting paper I2 is not confirmed since inserting paper I1 has not yet passed the detection position of the upper-tray inserting paper presence sensor 721. Thereafter, when inserting paper I1 is conveyed to the horizontal path 340, the trailing edge of inserting paper I1 finally passes through the detection position, and paper presence of inserting paper I2 is confirmed. Thereby, feeding of recording paper P2 whose last preceding page is inserting paper I2 is started.

Inserting paper I2 is conveyed to the horizontal path 340 only after recording paper P1 has passed through the merging position, and until then, paper presence of next inserting paper I3 is not confirmed. Paper presence of inserting paper I3 is confirmed when the inserting paper I2 is conveyed to the horizontal path 340, and feeding of recording paper P3 whose last preceding page is inserting paper I3 is started.

As described, the presence of inserting paper I3 is confirmed only after a series of events has occurred, which are the start of feeding of recording paper P1, passing of merging position by recording paper P1, and merging of inserting paper I2 to the horizontal path. Therefore, the length of delay time before feeding of recording paper P3 is started is restricted by a required time from feeding of recording paper P1 to the passing of merging position in the insert apparatus 3. In a mode where alternate feeding of inserting paper is not performed, similar to the case where the length of inserting paper I3 is relatively short, there is a case where the productivity of the image forming system is deteriorated by the elongated sheet-to-sheet interval of the insert job as the required time for conveying the recording paper to the merging position extends.

Figure 7B:
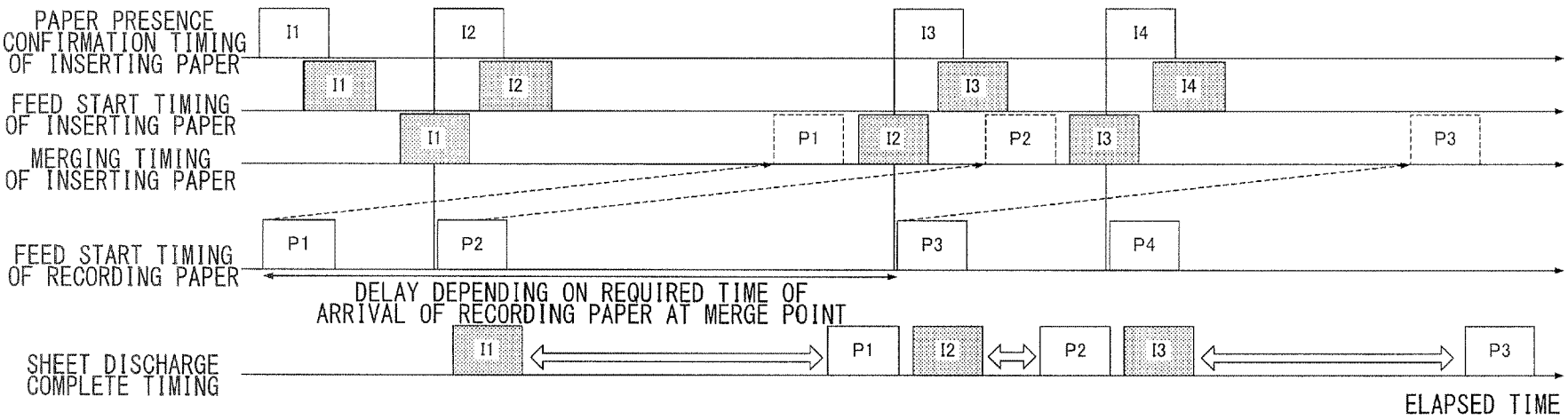
FIG. 7B is a conveyance timing chart of inserting paper and recording paper in a case where alternate feeding is not performed and the length of inserting paper is relatively long according to the first embodiment.

As illustrated in FIG. 7B, if inserting paper I1 is carried into the horizontal path 340 as soon as possible after starting the job, the timing of determination of paper presence of inserting paper I2 becomes earlier and start of feeding of recording paper P2 can be made earlier. However, the fact that paper presence of inserting paper I3 is confirmed only after a series of events has occurred, which are the start of feeding of recording paper P1, passing of merging position by recording paper P1, and merging of inserting paper I2 to the horizontal path, is similar to the case of FIG. 7A. Therefore, the delay until recording paper P3, whose last preceding page is inserting paper I3, can be fed is the same as the delay of FIG. 7A. In other words, the position in which a long sheet-to-sheet interval occurs differs, but the productivity of the insert job being deteriorated based on the length of required time for recording paper to be conveyed to the merging position is the same as the case of FIG. 7A.

As described, in a mode where alternate feeding of inserting paper is not performed, if feeding of recording paper whose last preceding page is the inserting paper is to be performed, there may be a case where waiting time occurs for confirming paper presence of inserting paper serving as last preceding page, depending on the required time for conveying the recording paper to the merging position. Therefore, the productivity of the insert job may be deteriorated greatly in an image forming system having a long conveyance path for conveying the recording paper to the merging position, or in a case where the required time to the merging position is elongated since images must be formed on both sides of the recording paper.

Sheet Conveyance Operation: When Alternate of Inserting Paper is Performed

Therefore, in the present embodiment, improvement of productivity is attained by performing alternate feeding of inserting paper. Now, conveyance operation of inserting paper and recording paper, that is, operation of alternate feeding mode, in a case where alternate feeding function of the insert apparatus 3 is effective, will be illustrated.

Figure 11A:
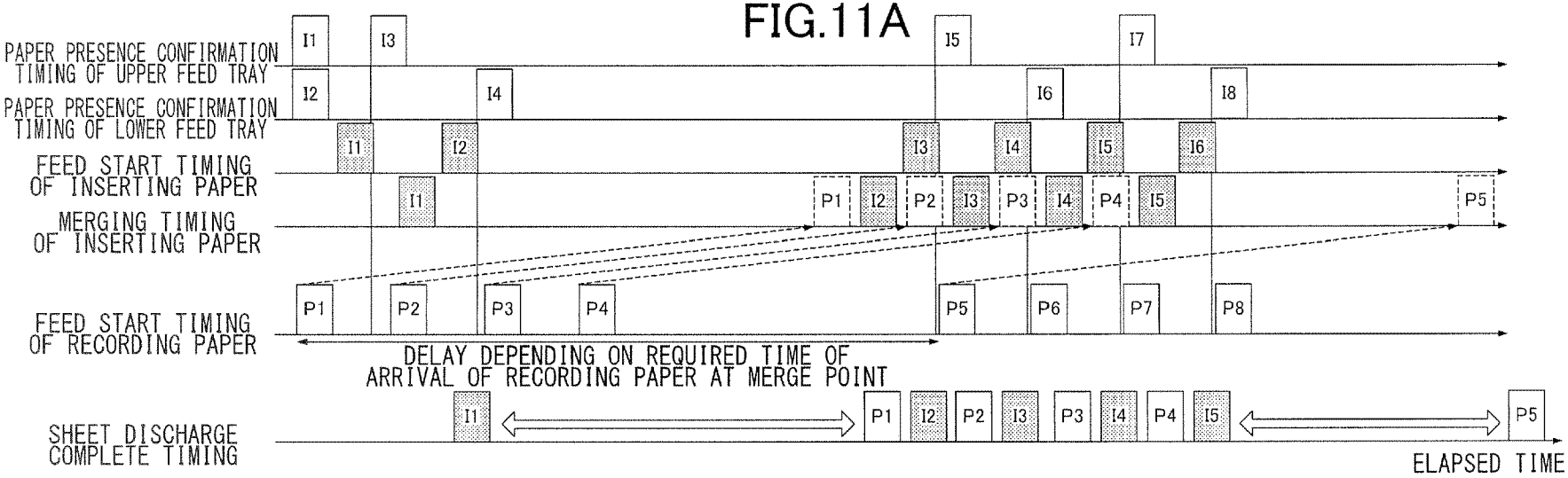
FIG. 11A is a conveyance timing chart of inserting paper and recording paper in a case where alternate feeding is performed according to the first embodiment.

FIG. 11A illustrates a conveyance timing of each page of inserting paper and recording paper. The contents of the insert job are the same as that illustrated in FIG. 6A, which is set to a page order in which inserting paper and recording paper are arranged alternately (refer to FIG. 4). It is assumed that the initial inserting paper I1 is fed from the upper feed tray 320.

Before starting the job, inserting paper is set on both the upper feed tray 320 and the lower feed tray 321, and both the upper-tray inserting paper presence sensor 721 and the lower-tray inserting paper presence sensor 722 detect presence of inserting paper. That is, at the time the job is started, paper presence of inserting paper I1 at the upper feed tray 320 is confirmed, and paper presence of inserting paper I2 at the lower feed tray 321 is also confirmed. At the time the job is started, it is determined that feeding of not only recording paper P1 whose last preceding page is inserting paper I1 but also recording paper P2 whose last preceding page is inserting paper I2 is enabled.

After starting the job, feeding of recording paper P1 is immediately started. Feeding of inserting paper I1 is started at an arbitrary timing enabling inserting paper I1 to be carried into the horizontal path 340 before recording paper P1 reaches the merging position of the horizontal path 340. In this state, by inserting paper I1 passing the determined position, that is, detection position of the upper-tray inserting paper presence sensor 721, paper presence of the next inserting paper I3 is confirmed. By confirming the paper presence of inserting paper I3, it is determined that the feeding of recording paper P3 whose last preceding page is inserting paper I3 can be performed.

Figure 12A:
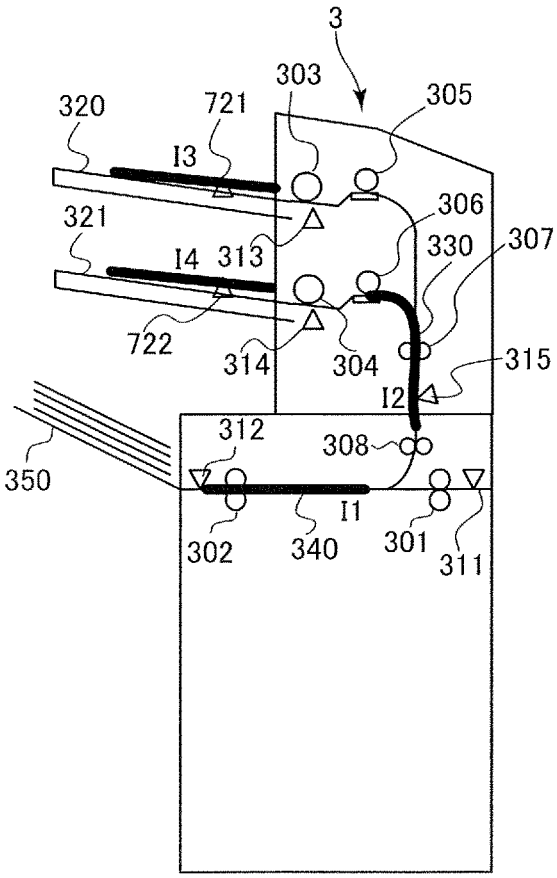
FIG. 12A is a view illustrating the state of conveyance operation of inserting paper in a case where alternate feeding is performed according to the first embodiment.

Next, when inserting paper I1 is carried into the horizontal path 340, inserting paper I2 is conveyed from the lower feed tray 321 to the merge-standby path 330 and awaits in a state where the leading edge is abutted against the registration roller 308. In this state, as illustrated in FIG. 12A, inserting paper I2 passes through the predetermined position, that is, the detection position of the lower-tray inserting paper presence sensor 722, and paper presence of the next inserting paper I4 is confirmed. By confirming the paper presence of inserting paper I4, it is determined that feeding of recording paper P4 whose last preceding page is inserting paper I4 can be performed.

Recording paper P2 to P4 whose feeding is determined possible is started to be fed while maintaining a minimum sheet-to-sheet interval capable of inserting the inserting paper I2 to I4 immediately before the recording paper at the horizontal path of the insert apparatus 3.

Compared to the case illustrated in FIGS. 6A and 6B where alternate feeding is not performed, the timing at which the paper presence of inserting paper I4 is confirmed is made earlier, and it can be recognized that start of feeding of recording paper P4 is made earlier. This is because in the alternate feeding mode illustrated in FIG. 11A, the timing at which paper presence of inserting paper I4 is confirmed does not depend on the required time for conveying recording paper P1 to the merging position.

In the case of alternate feeding mode, the paper presence of inserting paper I4 is confirmed without waiting for the start of feeding of inserting paper I3 which is directly preceding inserting paper I4 in the page order, by start of feeding of inserting paper I2, in other words, inserting paper that has been fed previously from the same sheet supply as inserting paper I4, further preceding inserting paper I3. Feeding of inserting paper I2 can be started without waiting for arrival of recording paper P1 at the merging portion, as long as inserting paper I1 is carried into the horizontal path 340. As a result, in the alternate feeding mode, the confirmation timing of paper presence of inserting paper I4 which is the condition for executing feed of recording paper P4 does not depend on the required time for conveying the recording paper P1 to the merging position. Therefore, by performing alternate feeding, at least the start of feeding of recording paper P4 in the insert job described above is made earlier, so that the productivity of the image forming system is improved.

Figure 12B:
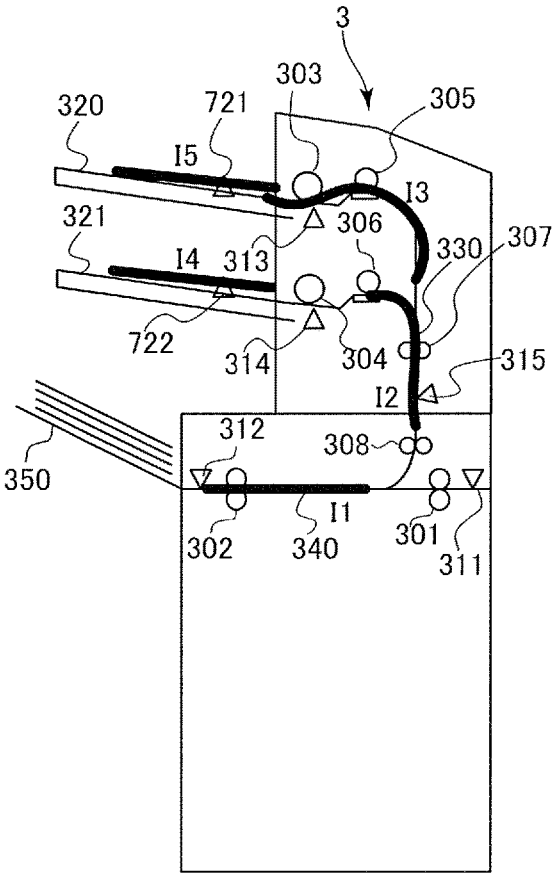
FIG. 12B is a view illustrating the state of conveyance operation of inserting paper in a case where alternate feeding is performed according to the first embodiment.

If restated, according to the alternate feeding mode, the presence of inserting paper serving as last preceding page is determined based on the detection result of presence of inserting paper at a plurality of supporting portions in order to determine whether to start feeding of a current recording paper, i.e., current recording sheet. Thereby, the number of inserting paper stocked in a state where paper presence is already confirmed can be increased compared to a configuration where presence of inserting paper serving as last preceding page is determined based on the detection result of presence of inserting paper at one supporting portion. For example, as illustrated in FIG. 12B, if movement processing of a second inserting sheet (I3) is performed during execution of processing for feeding a first inserting sheet (I2), the paper presence of the third inserting sheet (I4) and the fourth inserting sheet (I5) is confirmed. Further, as illustrated in FIG. 12A, even if movement processing is not performed, the paper presence of the sixth inserting sheet (I3) and the seventh inserting sheet (I4) is confirmed during execution of a process for feeding the fifth inserting sheet (I2). According to the present embodiment, by increasing the number of inserting paper whose paper presence has been confirmed, timing to start feeding of recording papers can be made earlier and productivity of the image forming system can be improved.

In the description illustrated in FIG. 11A, the inserting paper I2 is carried into the horizontal path 340 after the recording paper P1 has passed the merging position of the horizontal path 340, then the paper presence of inserting paper I5 is confirmed by the feeding of the inserting paper I3 being started and inserting paper I3 passing through predetermined position. When paper presence of inserting paper I5 is confirmed, feeding of recording paper P5 is immediately started. That is, according to the example illustrated in FIG. 11A, even if alternate feeding of inserting paper is performed, a delay time that depends on the required time for conveying recording paper P1 to the merging position occurs before the feeding of recording paper P5 whose last preceding page is inserting paper I5 is enabled. Therefore, a case occurs where a wider interval than the sheet-to-sheet interval required for inserting the inserting paper I5 occurs from the discharge complete timing of recording paper P4 to discharge complete timing of recording paper P5.

After the recording paper P1 passes through the merging position, the timings at which the inserting paper I3, I4 and I5 are carried into the horizontal path 340 are determined by a similar process based on a timing at which the recording paper P2, P3 and P4 are passed through the merging position. When the inserting papers I3, I4 and I5 are carried into the horizontal path 340, the paper presence of the inserting paper I6, I7 and I8 is confirmed, and feeding of recording paper P6, P7 and P8 is started. For example, when inserting paper I3 is carried into the horizontal path 340, feeding of inserting paper I4 is started and passed through the detection position of the lower-tray inserting paper presence sensor 722, by which paper presence of inserting paper I6 is confirmed by the lower-tray inserting paper presence sensor 722, and feeding of recording paper P6 is enabled.

Next, a case where the productivity of the image forming system can be further improved over the conveyance timing illustrated in FIG. 11A will be described with reference to FIG. 11B.

If the length of inserting paper is shorter than a predetermined length, the uppermost inserting paper on the upper feed tray 320 or the lower feed tray 321 can be moved downstream of the detection position of the inserting paper presence sensor 721 or 722 without interfering with the inserting paper standing by at the merge-standby path 330. That is, as illustrated in FIG. 12B, even if an inserting paper fed from one of the upper feed tray 320 and the lower feed tray 321 is standing by the merge-standby path 330, the paper presence of at least two inserting papers on the other tray can be confirmed.

Figure 11B:
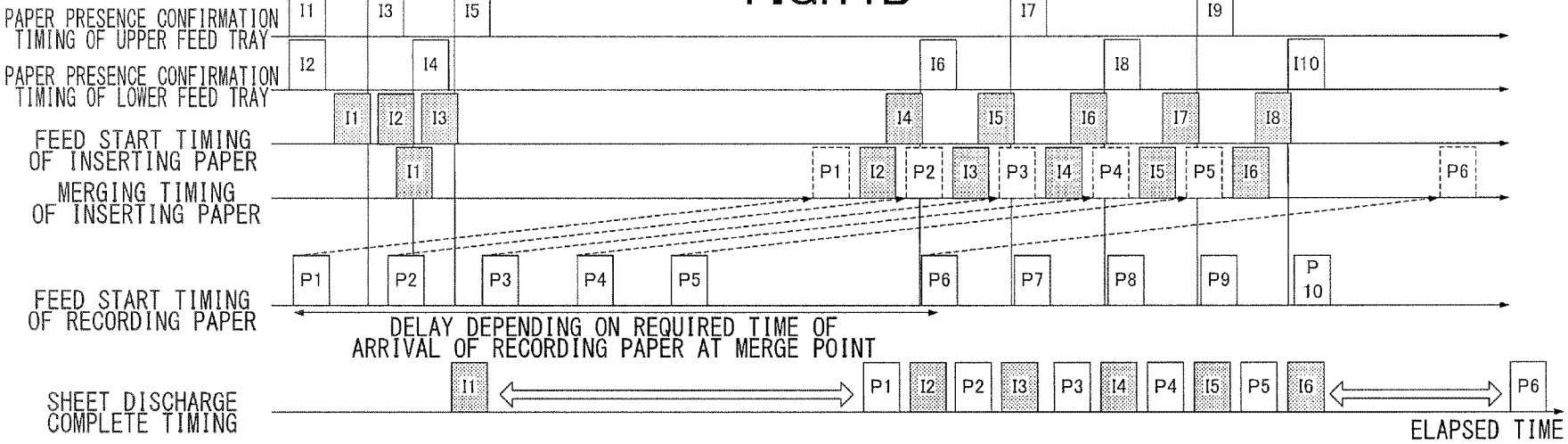
FIG. 11B is a conveyance timing chart of inserting paper and recording paper in a case where alternate feeding is performed according to the first embodiment.

In FIG. 11B, inserting paper is set to both the upper feed tray 320 and the lower feed tray 321 before starting the job, and both the upper-tray inserting paper presence sensor 721 and the lower-tray inserting paper presence sensor 722 are detecting presence of inserting paper. That is, at the start of the job, the paper presence of inserting paper I1 on the upper feed tray 320 is confirmed, and the paper presence of inserting paper I2 on the lower feed tray 321 is also confirmed. Therefore, at the timing of start of the job, the feeding of not only recording paper P1 whose last preceding page is inserting paper I1 but also recording paper P2 whose last preceding page is inserting paper I2 is determined to be enabled.

After starting the job, feeding of recording paper P1 is immediately started. Further, feeding of inserting paper I1 is started at an arbitrary timing to be carried into the horizontal path 340 before the recording paper P1 reaches the merging position on the horizontal path 340. In this state, the paper presence of subsequent inserting paper I3 is confirmed by the inserting paper I1 passing through the predetermined position, that is, detection position of the upper-tray inserting paper presence sensor 721. By confirming the paper presence of inserting paper I3, it is determined that feeding of recording paper P3 whose last preceding page is the inserting paper I3 is also enabled.

Next, when inserting paper I1 is carried into the horizontal path 340, inserting paper I2 is conveyed from the lower feed tray 321 to the merge-standby path 330 and set to standby in a state where the leading edge is abutted against the registration roller 308. Thereby, paper presence of inserting paper I4 on the lower feed tray 321 is confirmed, and it is determined that feeding of recording paper P4 whose last preceding page is inserting paper I4 is enabled.

Further, after starting feed of inserting paper I2, an operation of moving inserting paper I3 to the predetermined position is executed at the upper feed tray 320 as the movement processing of the present embodiment. Predetermined position is a position where the trailing edge of inserting paper I3 is positioned downstream in the feeding direction than the detection position of the upper-tray inserting paper presence sensor 721 and where the leading edge of inserting paper I3 is positioned upstream in the feeding direction than the merge-standby path 330. Therefore, as illustrated in FIG. 12B, the upper-tray inserting paper presence sensor 721 is enabled to detect inserting paper I5, and paper presence of inserting paper I5 is thereby confirmed. In other words, by performing a movement processing of conveying the second inserting sheet (I3) to the predetermined position during execution of a processing of feeding the first inserting sheet (I2) to the sheet conveyance path, presence of the inserting sheet (I5) other than the second inserting sheet can be confirmed earlier.

Therefore, in the example illustrated in FIG. 11B, in addition to inserting paper I1 to 14, the timing at which paper presence of inserting paper I5 is confirmed also does not rely on the required time for conveying the recording paper P1 to the merging position. Therefore, compared to FIG. 11A, the starting timing of feeding of recording paper P5 whose last preceding page is inserting paper I5 can be made earlier, and productivity of the image forming system can be improved further.

As for recording paper P2 to P5 whose feeding is determined to be possible, the feeding is started while maintaining a minimum sheet-to-sheet interval capable of having inserting paper I2 to I5 inserted immediately prior thereto in the horizontal path of the insert apparatus 3.

Then, after recording paper P1 has passed through the merging position of the horizontal path 340, inserting paper I2 is carried into the horizontal path 340. Next, the movement processing of inserting paper I4 which is the uppermost sheet on the lower feed tray 321 is performed, and inserting paper I4 passes through the detection position of the lower-tray inserting paper presence sensor 722 and stops after moving to a position upstream of the merge-standby path 330. Thereby, the paper presence of inserting paper I6 on the lower feed tray 321 is determined. If paper presence of inserting paper I6 is confirmed, feeding of recording paper P6 is immediately started.

Hereafter, conveyance timing of inserting paper I3, I4, I5 and I6 to the horizontal path 340 is determined by a similar process based on a timing at which recording paper P2, P3, P4 and P5 passes the merging position. When inserting paper I3, I4, I5 and I6 is carried into the horizontal path 340, paper presence of inserting paper I7, I8, I9 . . . is confirmed, and feeding of recording paper P7, P8, P9 . . . is started.

The conveyance timing illustrated in FIGS. 11A and 11B corresponds to the page order in which inserting paper and recording paper illustrated in FIG. 4 are arranged alternately. However, by using the alternate feeding mode, the number of inserting papers whose paper presence is confirmed can be increased, so that it is clear that the timing for determining paper presence of inserting paper can be made early even if the page order of inserting paper and recording paper differs. In other words, regardless of the page order, if the alternate feeding mode is used, a state will hardly occur where "the determining timing of paper presence of inserting paper is delayed depending on the required time for conveying a preceding recording paper to the merging position, and the subsequent recording paper must standby before being fed". Therefore, productivity of image forming system can be improved by the present embodiment.

Flow for Determining Whether Feeding is Enabled

Next, a method for controlling the image forming system for realizing the above-described conveyance operation is described. At first, the process for determining whether feeding of recording paper or inserting paper of each page is enabled will be described with reference to FIGS. 13 and 14. The processes of the flowchart of FIGS. 13 and 14 are executed by the CPU 901 of the printer controller 900.

Figure 13:
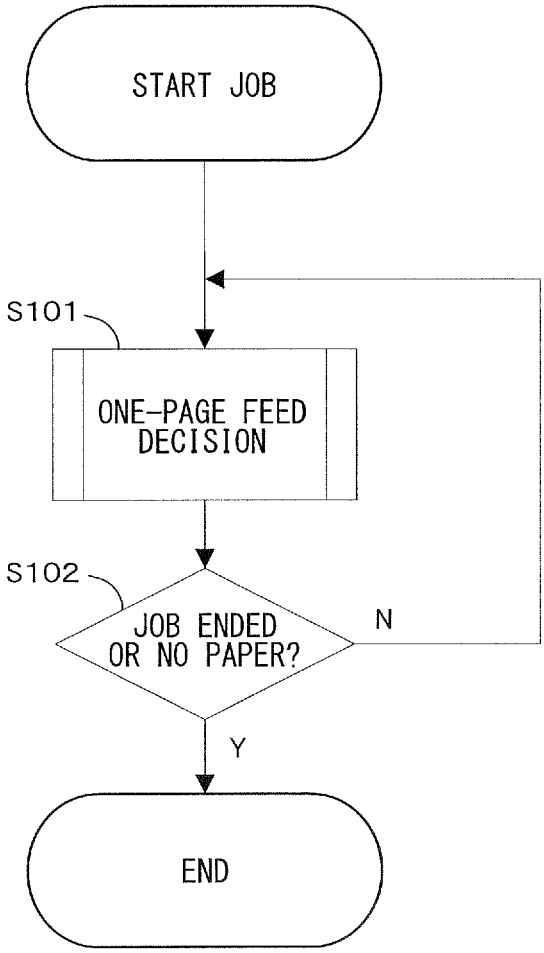
FIG. 13 is a flowchart illustrating a process for determining whether to feed inserting paper and recording paper according to the first embodiment.

When a job is started, at S101 of FIG. 13, the CPU 901 performs a one-page feed decision. In the present embodiment, information on each page of the job is set to be queued in the RAM 903, feeding portion information indicating which feeding portion in the image forming apparatus 1 and the insert apparatus 3 the sheet corresponding to a certain page is fed from is included in the respective page information. In a state where a one-page feed decision is completed, the procedure advances to S102. In S102, regarding the page information queuing in the RAM 903, the flow is ended if there is no more page to be fed or if a notice that the sheet is not present is received from any of the feeding portions. If a page to be fed next is queued in the RAM 903, the procedure advances to S101 again and the aforementioned one-page feed decision is performed.

Figure 14:
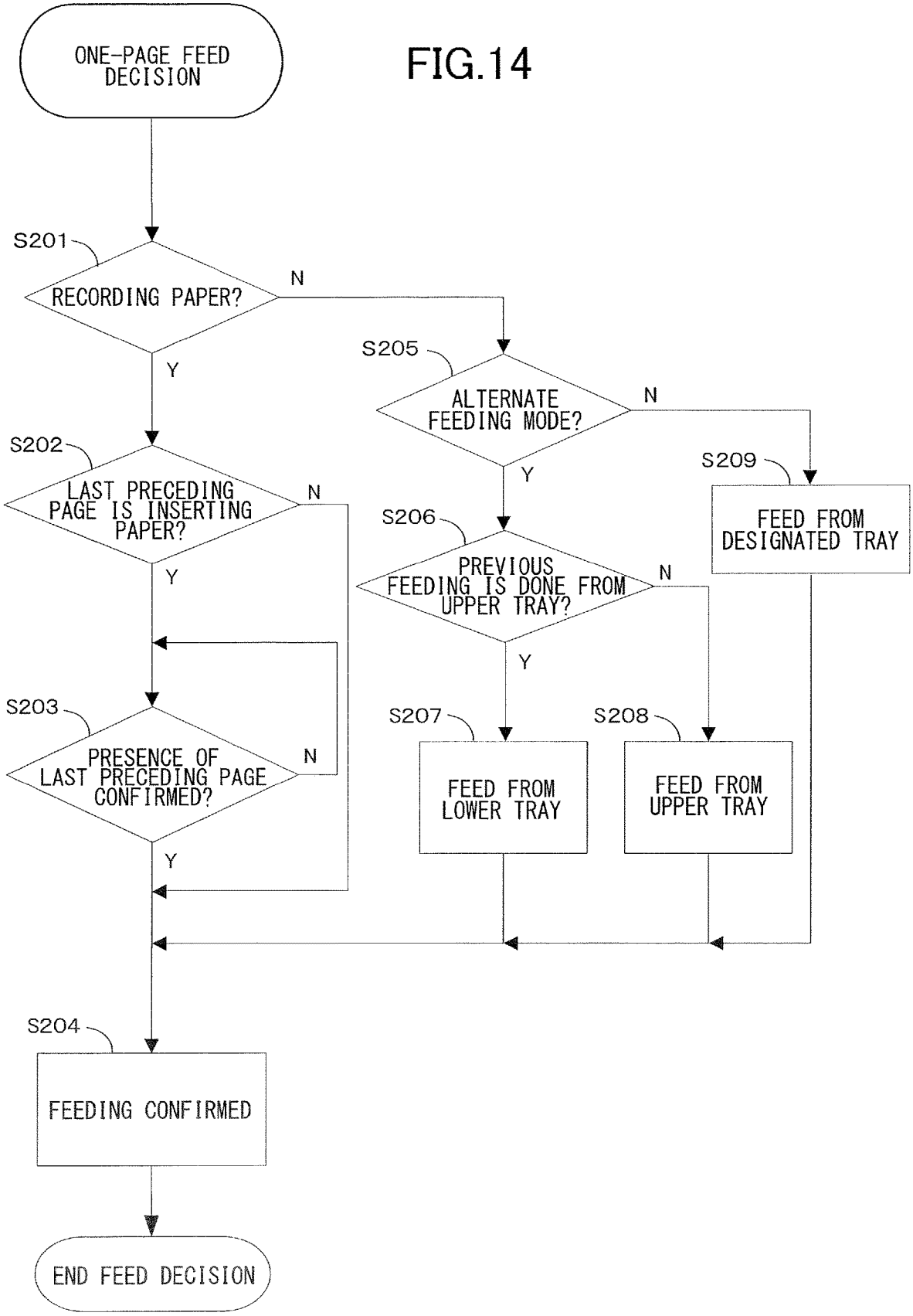
FIG. 14 is a flowchart illustrating a content of one-page feed decision of FIG. 13.

FIG. 14 illustrates the content of one-page feed decision. In S201, the CPU 901 determines whether the paper to be fed from the RAM 903 at this time is recording paper or inserting paper, that is, whether the paper is fed from the image forming apparatus 1 or from the insert apparatus 3. If it is recording paper, the procedure advances to S202, and feeding portion information of a last preceding page of the current recording paper is read. If the last preceding page is not inserting paper, the procedure advances to S204. If the sheet is the first sheet of the job, there is no last preceding page, so that the procedure advances to S204 without performing any process.

In S202, if the last preceding page is inserting paper, the procedure advances to S203, where it is determined whether paper presence of the last preceding page is confirmed. Whether paper presence is confirmed is determined based on the notice from the inserter controller 700 to the printer controller 900. If paper presence is not determined, the determination of S203 is repeated until the paper presence is determined. After determining the paper presence, the procedure advances to S204.

Meanwhile, in S201, if the paper being fed is not recording paper, that is, if it is inserting paper, the procedure advances to S205. In S205, whether the alternate feeding function is valid is determined. If the alternate feeding function is valid, that is, if the alternate feeding mode is set, the procedure advances to S206, and determines whether the feed source of the preceding inserting paper was the upper feed tray 320. If the preceding inserting paper was fed from the upper feed tray 320, the procedure advances to S207, and the feed source of the current inserting paper is set to the lower feed tray 321. In contrast, if the preceding inserting paper was fed from the lower feed tray 321, the procedure advances to S208, and the feed source of the current inserting paper is set to the upper feed tray 320.

If the alternate feeding function is not valid in S205, the procedure advances to S209, and the tray set as the feed source of inserting paper at the start of the job, that is, the upper feed tray 320 or the lower feed tray 321 selected on the screen of FIG. 10D, is set as the feed source of the current inserting paper.

Since it is determined in S204 that the sheet to be fed is feedable, the procedure stores that feeding is confirmed in page information, outputs a command to feed the feeding portion of the image forming apparatus 1 or the insert apparatus 3 to perform feeding, and ends the one-page feed decision. In this state, the actual timing at which the feeding portion of the image forming apparatus 1 or the insert apparatus 3 starts feeding recording paper or inserting paper is controlled arbitrarily so that an appropriate sheet-to-sheet interval is maintained at the horizontal path 340 in the insert apparatus 3.

According to the feed decision of respective pages described above, in S203 of FIG. 14, if the last preceding page of the current recording paper is the inserting paper, feeding of current recording paper is confirmed after the paper presence of inserting paper serving as last preceding page is confirmed. Since the feeding of current recording paper is started after confirming that paper presence of inserting paper serving as the last preceding page has been confirmed, it becomes possible to prevent the inserting paper serving as last preceding page from being depleted after feeding of recording paper has been started and causing an incomplete product having an inappropriate page order to be discharged. As described, by feeding inserting paper from the upper feed tray 320 and the lower feed tray 321 alternately in the alternate feeding mode, it becomes possible to increase the number of inserting papers whose paper presence has been confirmed. Thereby, the productivity of the image forming system in the insert job can be improved while preventing discharge of incomplete products.

Feed Control Flow of Insert Apparatus

Figure 15:
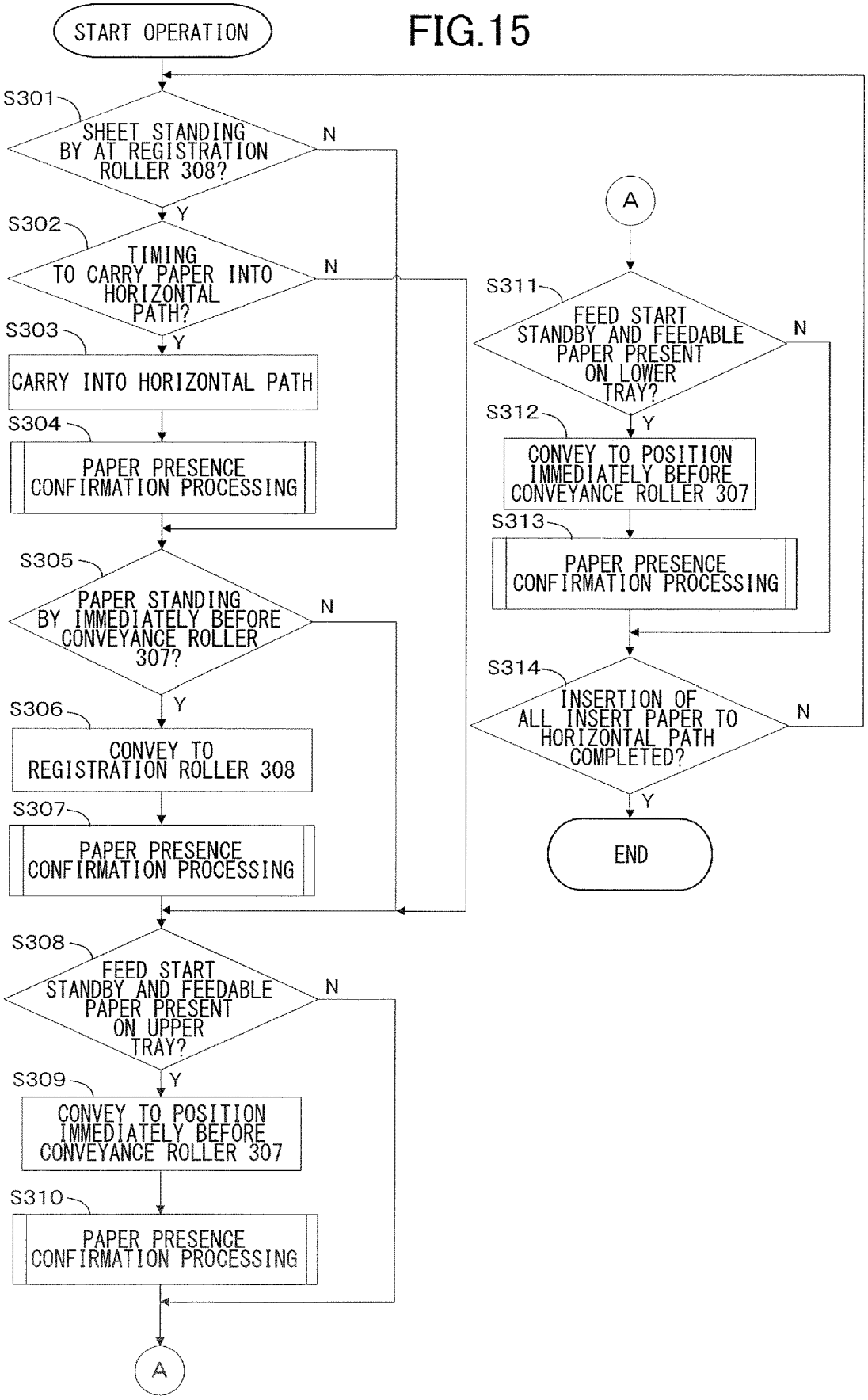
FIG. 15 is a flowchart illustrating a process for controlling operation of the insert apparatus according to the first embodiment.
Figure 16:
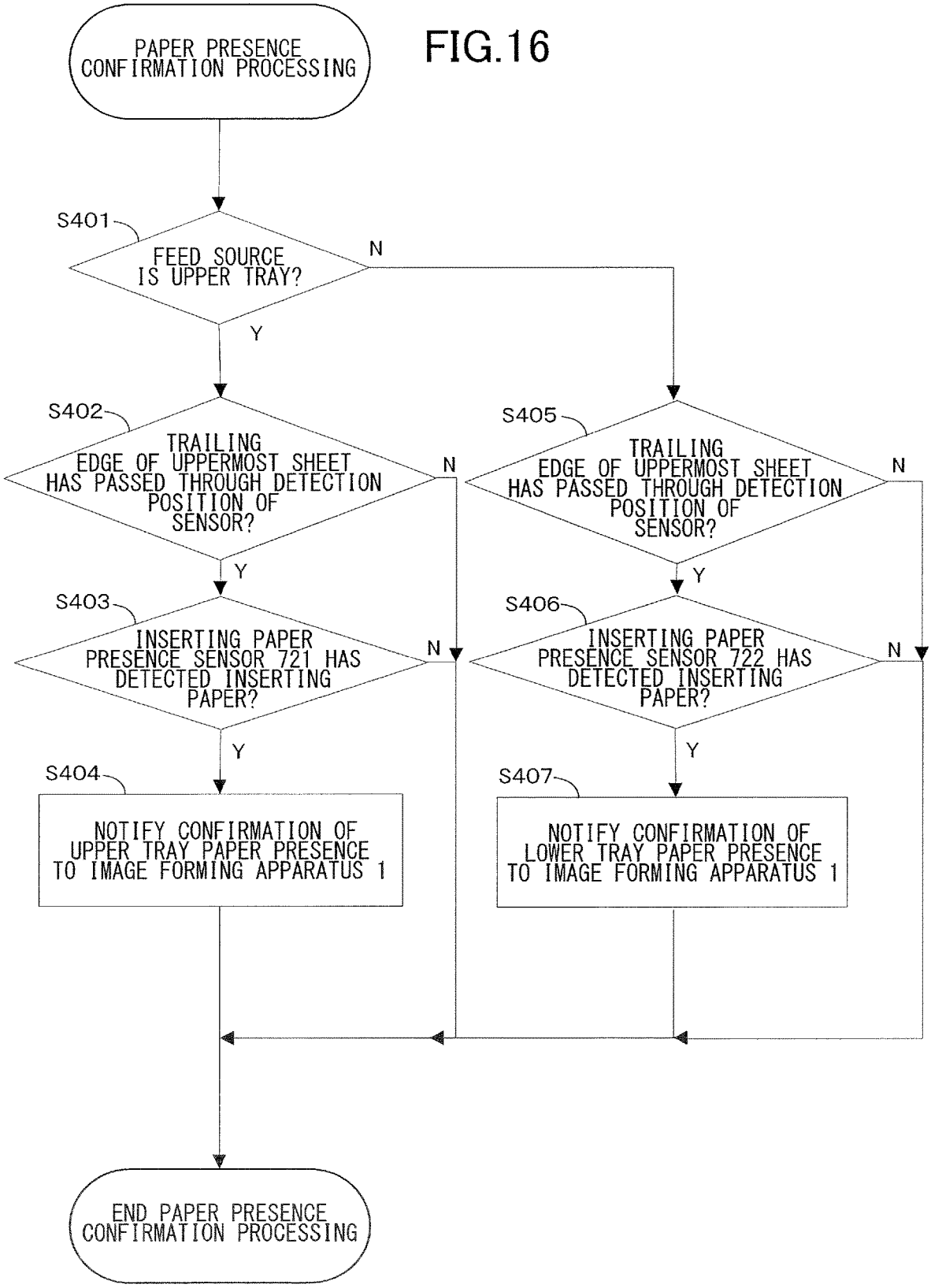
FIG. 16 is a flowchart illustrating a content of paper presence confirmation processing according to FIG. 15.

Feed Control Flow of the insert apparatus 3 will be described with reference to FIGS. 15 and 16. Each step in the flowcharts of FIGS. 15 and 16 is executed by the CPU 701 of the inserter controller 700. The flowcharts of FIGS. 15 and 16 illustrate an operation including a movement processing of moving an inserting paper of one tray to a predetermined position in a state where inserting paper from the other tray is in the merge-standby path 330, as illustrated in FIG. 11B.

The inserter controller 700 starts the following operation based on a notice received from the printer controller 900 when starting execution of the job. When operation is started, at first in S301, the CPU 701 determines whether there is an inserting paper in standby at the registration roller 308 to be carried into the horizontal path 340. If there is none, the procedure advances to S305. If there is an inserting paper in standby, the procedure advances to S302.

In S302, whether the timing has come to carry paper into the horizontal path 340 is determined. The timing to carry in paper to the horizontal path 340 is determined, for example, based on information related to page number of the inserting paper notified from the printer controller 900 and detection result of the inlet sensor 311 of the insert apparatus 3. If it is not the carry-in timing, the procedure advances to S308. If it is the carry-in timing, the procedure advances to S303, and inserting paper is carried into the horizontal path 340. Next, the procedure advances to S304, where paper presence confirmation processing is performed. Thereafter, the procedure advances to S305.

In S305, it is determined whether there is an inserting paper in standby at a predetermined position upstream of the merge-standby path 330, for example, at a position immediately before the conveyance roller 307, in the process of S309 or S312, i.e., movement processing, described later. If there is no inserting paper in standby, the procedure advances to S308. If there is an inserting paper in standby, the procedure advances to S306, the inserting paper will be conveyed until the leading edge thereof reaches the registration roller 308, and then, the paper will be in standby at the registration roller 308 to be carried into the horizontal path 340. Next, the procedure advances to S307, the paper presence confirmation processing described later will be performed. Thereafter, the procedure advances to S308.

In S308, the procedure determines whether there is an inserting paper in standby for start of feeding at the upper feed tray 320, that is, in a state where feeding from the upper tray is confirmed in S208 and S204 of FIG. 14 and feeding has not been started, and capable of being conveyed to the predetermined position. If there is no inserting paper that is in standby for start of feeding and conveyable to the predetermined position, the procedure advances to S311. If there is an inserting paper in standby for start of feeding and conveyable to the predetermined position, the procedure advances to S309, and the uppermost inserting paper on the upper feed tray 320 is conveyed to the predetermined position. Next, the procedure advances to S310, where paper presence confirmation processing described above will be performed, before the procedure advances to S311.

In S311, the procedure determines whether there is an inserting paper on the lower feed tray 321 in standby for start of feeding and that is conveyable to a position immediately before the conveyance roller 307. If there is no inserting paper in standby for start of feeding and conveyable to the predetermined position, the procedure advances to S314. If there is an inserting paper in standby for start of feeding and conveyable to the predetermined position, the procedure advances to S312, and the uppermost inserting paper on the lower feed tray 321 is conveyed to the predetermined position. Next, the procedure advances to S313, and paper presence confirmation processing described later is performed, before the procedure advances to S314.

In S314, whether the conveyance of all inserting paper to the horizontal path 340 has been completed is determined. If it is not completed, the procedure returns to S301, and the processes from S301 to S314 are repeated. In a case where carrying in of all inserting paper to the horizontal path 340 is completed, the procedure is ended.

Next, the paper presence confirmation processing of FIG. 16 will be described. As described in FIG. 15, the paper presence confirmation processing is invoked at a timing where the presence of next inserting paper can be confirmed at either one of the upper feed tray 320 and the lower feed tray 321 by the movement of the preceding inserting paper.

In S401, the CPU 701 determines whether the feed source of inserting paper being the target of the current decision is the upper feed tray 320. If the feed source is the upper feed tray 320, the procedure advances to S402. If the feed source is not the upper feed tray 320 but the lower feed tray 321, the procedure advances to S405.

In S402, whether the trailing edge of the preceding inserting paper has passed through the upper-tray inserting paper presence sensor 721 is confirmed. If it had passed therethrough, the procedure advances to S403. If the trailing edge of the preceding inserting paper had not passed through the upper-tray inserting paper presence sensor 721, the paper presence confirmation processing is ended. In S403, whether the upper-tray inserting paper presence sensor 721 has detected inserting paper is determined. If inserting paper has been detected, the procedure advances to S404, and if not, the paper presence confirmation processing is ended. In S404, after notifying the image forming apparatus 1 that the inserting paper being the target of determination is placed on the upper feed tray 320, i.e., paper is present, the paper presence confirmation processing is ended.

In S405, whether the trailing edge of the preceding inserting paper had passed through the lower-tray inserting paper presence sensor 722 is determined. If pass-through is determined, the procedure advances to S406. If the trailing edge of the preceding inserting paper had not passed through the lower-tray inserting paper presence sensor 722, the paper presence confirmation processing is ended. In S406, whether the lower-tray inserting paper presence sensor 722 has detected inserting paper is determined. If detected, the procedure advances to S407, and if not detected, the paper presence confirmation processing is ended. In S407, after notifying the image forming apparatus 1 that the inserting paper being the target of determination is placed on the lower feed tray 321, i.e., paper is present, the paper presence confirmation processing is ended.

Based on the information notified by the above-described paper presence confirmation processing, the printer controller 900 determines that feeding of recording paper is enabled after determining in S203 of FIG. 14 that paper presence of inserting paper serving as last preceding page is confirmed.

If the alternate feeding mode is not set, the processing of the tray not set as the feed source of inserting paper in FIGS. 15 and 16 is omitted. For example, if the feed source of inserting paper is the upper feed tray 320, the processes of S311 to S313 of FIG. 15 and S405 to S407 of FIG. 16 should be skipped.

Further, the movement processing as illustrated in FIG. 11B or FIG. 12B cannot be performed since the inserting paper is long or the like, S305 to S307 of FIG. 15 is omitted, and inserting paper is conveyed to the registration roller 308 in S309 and S312. Thereby, conveyance operation of inserting paper described with reference to FIGS. 11A and 12A is realized.

Second Embodiment

According to the first embodiment, alternate feeding has been described assuming that the same inserting paper is basically set to the upper feed tray 320 and the lower feed tray 321 of the insert apparatus 3. In the second embodiment, a case is described where inserting paper is set in a state where a plural number of inserting papers constitutes one group, that is, set as a stack.

Figure 17A:
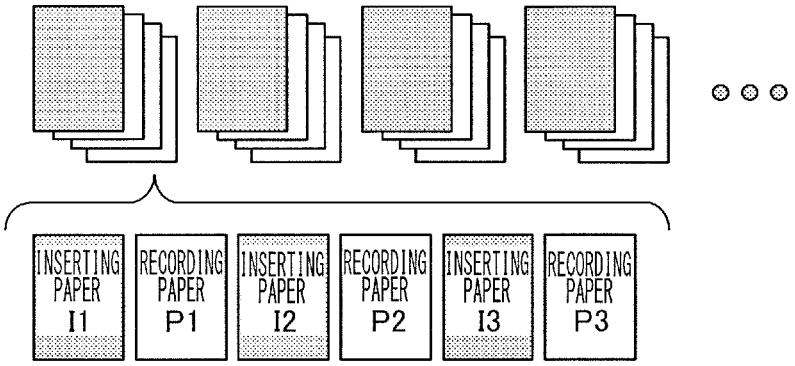
FIG. 17A is a conceptual diagram illustrating page order of product according to a second embodiment.
Figure 17B:
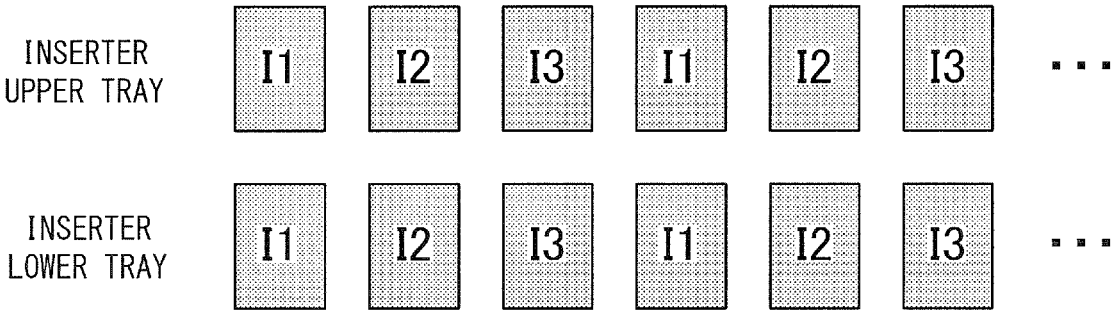
FIG. 17B is a conceptual diagram illustrating a method for setting inserting paper according to the second embodiment.

FIG. 17A illustrates an image of a sheet bundle serving as a product according to the present embodiment. FIG. 17B illustrates an order of placement of inserting paper set to the upper feed tray 320 and the lower feed tray 321. As illustrated in FIGS. 17A and 17B, according to the present embodiment, a predetermined number of inserting papers I1 to I3 included in the same product, which according to the illustrated example is three, is set to the upper feed tray 320 or the lower feed tray 321 as one group so as to be fed from the same sheet supply.

Alternate Feeding of Inserting Paper Set as Group

As illustrated in FIG. 17A, a method for alternately feeding inserting paper from a plurality of supporting portions of the insert apparatus 3 in an insert job where inserting paper set as a group is inserted after each recording paper will be described. Alternate feeding of inserting paper according to the present embodiment denotes an operation where inserting paper is fed by alternately switching the feed source of inserting paper between the upper feed tray 320 and the lower feed tray 321 each time a group of predetermined number of inserting papers is fed.

Figure 18:
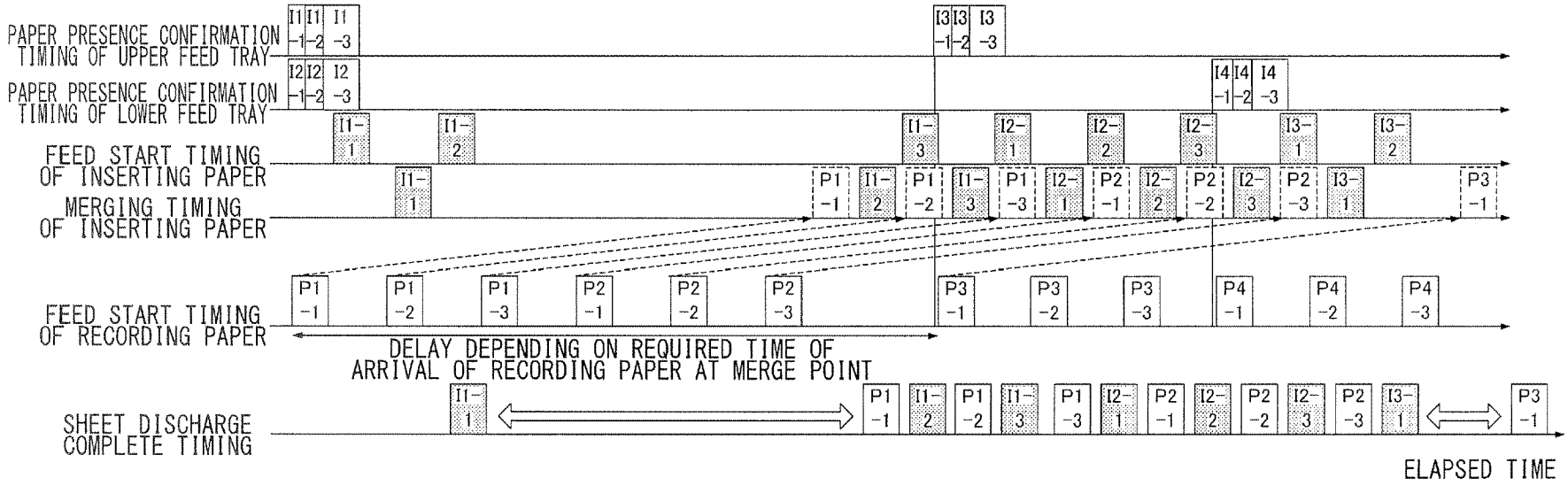
FIG. 18 is a conveyance timing chart of inserting paper and recording paper according to the second embodiment.

FIG. 18 illustrates a relationship of feed start timing of each page. It is assumed that a necessary number of groups of inserting paper is set to each of the upper feed tray 320 and the lower feed tray 321 before starting the job. That is, at the job start time, it is detected by the upper-tray inserting paper presence sensor 721 and the lower-tray inserting paper presence sensor 722 that at least one inserting paper is present in each of the upper feed tray 320 and the lower feed tray 321. In this case, according to the present embodiment, it is assumed that the presence of at least one group of inserting paper I1-1, I1-2 and I1-3 at the upper feed tray 320 is confirmed, and that the presence of at least one group of inserting paper I2-1, I2-2 and I2-3 at the lower feed tray 321 is confirmed.

The inserting paper I1-1 which is the uppermost inserting paper placed on the upper feed tray 320 and which is inserted to the head of the job is unconditionally feedable, since the last preceding page does not exist. Simultaneously, the recording paper P1-1, P1-2, P1-3, P2-1, P2-2 and P2-3, whose respective last preceding page are the inserting paper I1-1, I1-2, I1-3, I2-1, I2-2 and I2-3, the presence of which is confirmed at the time the job is started, are feedable. Therefore, after starting the job, feeding of the recording paper P1-1 is started immediately.

Figure 19A:
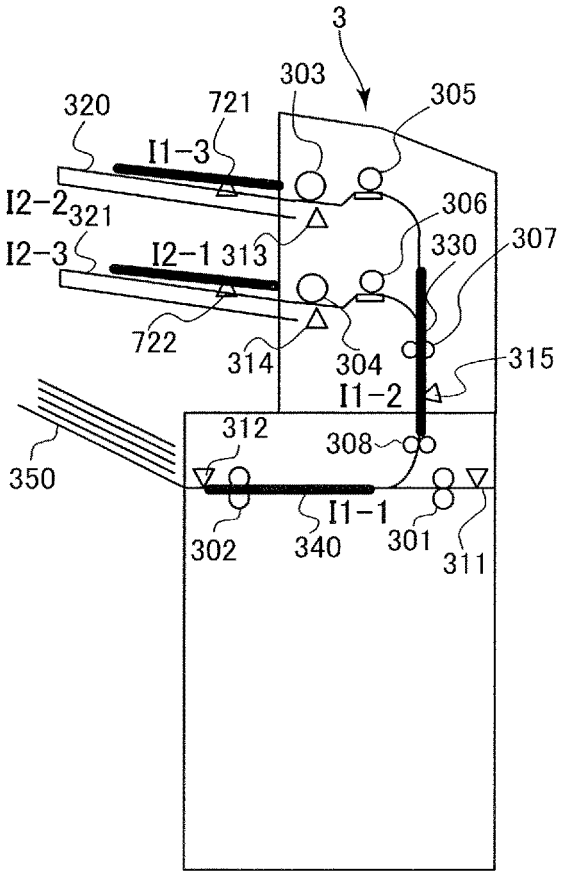
FIG. 19A is a view illustrating a state of conveyance operation of inserting paper according to the second embodiment.

If the inserting paper I1-1 is conveyed from the upper feed tray 320, passed through the registration roller 308 and carried into the horizontal path 340 in the inserter, the inserting paper I1-2 is conveyed from the upper feed tray 320 and the leading edge thereof reaches the registration roller 308 (FIG. 19A). Further, since the recording paper P1-2, P1-3, P2-1, P2-2 and P2-3 are feedable, feeding thereof is started while maintaining an appropriate sheet-to-sheet interval for inserting the inserting paper I1-2, I1-3, I2-1 I2-2 and I2-3 immediately before the recording paper in the horizontal path 340.

In a state where recording paper P1-1 passes through the merging position of the inserted and inserting paper I1-2 serving as a subsequent page is carried into the horizontal path 340, inserting paper I1-3 will be conveyed from the upper feed tray 320 and the leading edge thereof reaches the registration roller 308. In this state, inserting paper I3-1 is detected by the upper-tray inserting paper presence sensor 721 at the upper feed tray 320, and it is determined that paper presence of the next group of inserting paper I3-1, I3-2 and I3-3 has been confirmed. Thereby, recording paper P3-1, P3-2 and P3-3 whose last preceding page is inserting paper I3-1, I3-2 and I3-3 becomes feedable, and they are started to be fed while maintaining an appropriate sheet-to-sheet interval for inserting the inserting paper I3-1, I3-2 and I3-3 immediately before the recording paper at the horizontal path 340.

Figure 19B:
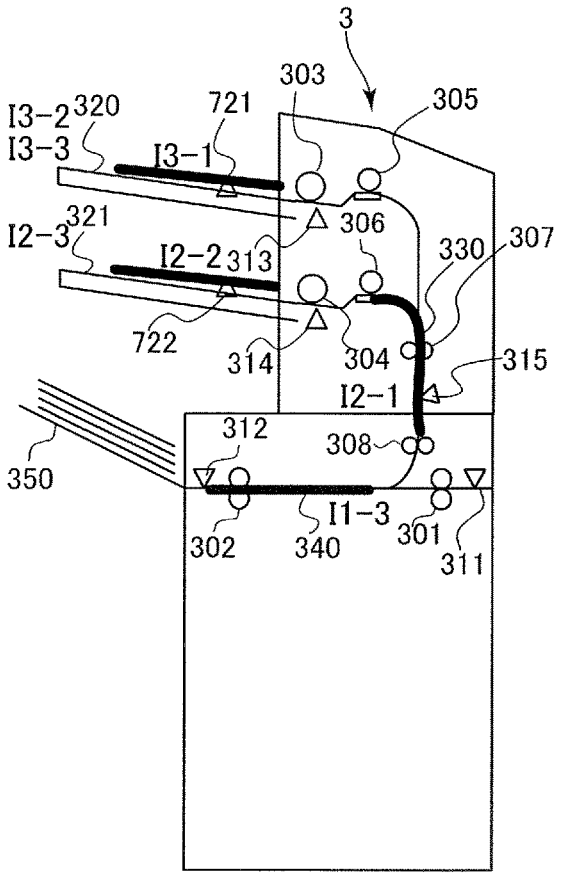
FIG. 19B is a view illustrating a state of conveyance operation of inserting paper according to the second embodiment.

Further, in a state where the inserting paper I1-3 is carried into the horizontal path 340 of the inserter in succession to the recording paper P1-2, the inserting paper I2-1 is conveyed from the lower feed tray 321 and the leading edge thereof reaches the registration roller 308 (FIG. 19B).

In a similar process, the conveyance timing of the inserting paper I2-1 and I2-2 to the horizontal path 340 in succession to the recording paper P1-3 and P2-1 is determined by a similar process, and thereby, it is determined that the paper presence of the next group of inserting paper I4-1, I4-2 and I4-3 is confirmed at the lower feed tray 321. Therefore, recording paper P4-1, P4-2 and P4-3 becomes feedable, and feeding thereof is started while maintaining an appropriate sheet-to-sheet interval for inserting the inserting paper I4-1, I4-2 and I4-3 immediately before the recording paper in the horizontal path 340.

As described, in a configuration according to the present embodiment where a predetermined number of inserting papers are set as one group, the feed start timing of recording paper whose last preceding page is this group of inserting paper is determined based on the detection result on whether the group of inserting paper is present in the plurality of supporting portions. Thereby, it becomes possible to increase the number of groups of inserting paper stocked in a state where paper presence is already confirmed compared to a configuration where the presence/absence of the group of inserting paper serving as the last preceding page is determined based on the detection result of the presence/absence of inserting paper at one supporting portion. Thereby, the feed start timing of recording paper can be set earlier, and productivity of the image forming system can be improved.

MODIFIED EXAMPLE

In the first and second embodiments described above, alternate feeding of inserting paper in a case where two supporting portions, which are the upper feed tray 320 and the lower feed tray 321, are provided as an example of the plurality of supporting portions on the insert apparatus 3 has been illustrated. The present technique is applicable to a configuration where three or more supporting portions are provided on the insert apparatus 3. In that case, alternate feeding refers to switching the feed source of inserting paper and performing feeding each time an inserting papers is fed, or each time a group of a predetermined number of inserting paper is fed, among two or more supporting portions selected in advance from three or more supporting portions. Also according to this case, similar to the first and second embodiments, the productivity of the image forming system in the insert job can be improved by increasing the number of inserting papers, or the number of groups of inserting paper, stocked in a state where paper presence is confirmed.

According to the embodiment illustrated above, the image forming system 1S where the image forming apparatus 1 including the image forming portion 80 is connected to the insert apparatus 3 has been described. However, the present technique is also applicable to a configuration where the function of the insert apparatus 3 is built into the image forming apparatus 1. This type of image forming apparatus is another example of an image forming system equipped with a first feeding portion for feeding recording sheet and a second feeding portion for feeding inserting sheet.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-088460, filed on May 8, 2019, which is hereby incorporated by reference herein in its entirety.

What is claimed is:

1. An image forming system comprising:

a first feeding portion configured to feed a recording sheet;

an image forming portion configured to form an image on a recording sheet fed from the first feeding portion;

a sheet conveyance path through which a recording sheet on which an image has been formed by the image forming portion is conveyed;

a second feeding portion comprising a plurality of supporting portions each configured to support an inserting sheet, and configured to feed an inserting sheet from any of the plurality of supporting portions toward the sheet conveyance path, the plurality of supporting portions including a first supporting portion and a second supporting portion;

a detection portion configured to detect presence of an inserting sheet supported on each of the plurality of supporting portions; and a controller configured to execute a job including a feeding process in which a recording sheet is fed from the first feeding portion and is formed an image thereon by the image forming portion, and a process in which an inserting sheet is fed from the second feeding portion and is inserted between recording sheets, the controller being configured to execute, during execution of a process of feeding a first inserting sheet from the first supporting portion to the sheet conveyance path, a movement processing of moving a second inserting sheet supported on the second supporting portion to a position where a trailing edge of the second inserting sheet is placed downstream in a sheet conveyance direction of a detection position of the detection portion and thereafter stopping the second inserting sheet.

2. The image forming system according to claim 1, wherein the controller is configured to execute a feeding process of a current recording sheet if a detection result of the detection portion indicates that an inserting sheet to be inserted immediately before the current recording sheet in an order of passing through the sheet conveyance path is present on any of the plurality of supporting portions.

3. The image forming system according to claim 1, wherein the controller is capable of executing a first mode in which a feed source of an inserting sheet is changed among the plurality of supporting portions each time one inserting sheet is fed during execution of the job, and the controller is configured to execute the movement processing in a case where the first mode is set.

4. The image forming system according to claim 3, wherein the detection portion comprises a first detection unit configured to detect presence of an inserting sheet supported on the first supporting portion, and a second detection unit configured to detect presence of an inserting sheet supported on the second supporting portion, and wherein in a state where the movement processing is executed during execution of a process for feeding the first inserting sheet, the first detection unit detects a third inserting sheet supported on the first supporting portion, and the second detection unit detects a fourth inserting sheet supported on the second supporting portion, the third inserting sheet being an inserting sheet to be conveyed to the sheet conveyance path after the second inserting sheet, the fourth inserting sheet being an inserting sheet to be conveyed to the sheet conveyance path after the third inserting sheet.

5. The image forming system according to claim 4, wherein the second feeding portion comprises a first conveyance path through which an inserting sheet fed from the first supporting portion passes, a second conveyance path through which an inserting sheet fed from the second supporting portion passes and which merges with the first conveyance path, and a third conveyance path that is communicated to the sheet conveyance path from a merging position of the first conveyance path and the second conveyance path, and wherein the controller is configured to execute the movement processing such that the second inserting sheet is moved to a position where a trailing edge of the second inserting sheet in the sheet conveyance direction is placed downstream of a detection position of the second detection unit and where a leading edge of the second inserting sheet in the sheet conveyance direction is placed upstream of the merging position, and thereafter, stops the second inserting sheet.

6. The image forming system according to claim 1, wherein the controller is capable of executing a second mode in which, in a case where any of the plurality of supporting portions is set as a current feed source of an inserting sheet, a feed source of an inserting sheet is not changed from the current feed source as long as a detection result of the detection portion indicates that at least one inserting sheet is present at the current feed source.

7. An image forming system comprising:

a first feeding portion configured to feed a recording sheet;

an image forming portion configured to form an image on a recording sheet fed from the first feeding portion;

a sheet conveyance path through which a recording sheet on which an image has been formed by the image forming portion is conveyed;

a second feeding portion comprising a plurality of supporting portions each configured to support an inserting sheet, and configured to feed an inserting sheet from any of the plurality of supporting portions toward the sheet conveyance path;

a detection portion configured to detect presence of an inserting sheet supported on each of the plurality of supporting portions; and a controller configured to execute a job including a feeding process in which a recording sheet is fed from the first feeding portion and is formed an image thereon by the image forming portion, and a process in which an inserting sheet is fed from the second feeding portion and is inserted between recording sheets, the controller being configured to change a feed source of an inserting sheet among the plurality of supporting portions in the second feeding portion each time one inserting sheet is fed during execution of the job, and execute a feeding process of a current recording sheet if a detection result of the detection portion indicates that an inserting sheet to be inserted immediately before the current recording sheet in an order of passing through the sheet conveyance path is present on any of the plurality of supporting portions.

8. The image forming system according to claim 7, wherein the detection portion comprises a first detection unit configured to detect presence of an inserting sheet supported on a first supporting portion among the plurality of supporting portions, and a second detection unit configured to detect presence of an inserting sheet supported on a second supporting portion among the plurality of supporting portions, and wherein during execution of a process for feeding a fifth inserting sheet to the sheet conveyance path from the first supporting portion, the second detection unit detects a sixth inserting sheet to be conveyed to the sheet conveyance path after the fifth inserting sheet, and the first detection unit detects a seventh inserting sheet to be conveyed to the sheet conveyance path after the sixth inserting sheet.

9. An image forming system comprising:

a first feeding portion configured to feed a recording sheet;

an image forming portion configured to form an image on a recording sheet fed from the first feeding portion;

a sheet conveyance path through which a recording sheet on which an image has been formed by the image forming portion is conveyed;

a second feeding portion comprising a plurality of supporting portions each configured to support an inserting sheet, and configured to feed an inserting sheet from any of the plurality of supporting portions toward the sheet conveyance path;

a detection portion configured to detect presence of an inserting sheet supported on each of the plurality of supporting portions; and a controller configured to execute a job of creating a sheet bundle in which a predetermined number of inserting sheets are inserted between a plurality of recording sheets, the job including a feeding process in which a recording sheet is fed from the first feeding portion and is formed an image thereon by the image forming portion, and a process in which an inserting sheet is fed from the second feeding portion and is inserted between recording sheets, the controller being configured to change a feed source of an inserting sheet among the plurality of supporting portions in the second feeding portion each time the predetermined number of inserting sheets are fed during execution of the job, and execute feeding processes of recording sheets used for creating a current sheet bundle if a detection result of the detection portion indicates that at least one inserting sheet to be used for creating the current sheet bundle is present on any of the plurality of supporting portions.

* * * * *